US007262379B2

(12) United States Patent
Nishimura et al.

(10) Patent No.: US 7,262,379 B2
(45) **Date of Patent: *Aug. 28, 2007**

(54) KEY SHEETS AND METHOD OF PRODUCING THE SAME

(75) Inventors: Takeshi Nishimura, Tokyo (JP); Kengo Nishi, Tokyo (JP); Masaya Katori, Tokyo (JP)

(73) Assignee: Polymatech Co., Ltd. (JP)

( * ) Notice: Subject to any disclaimer, the term of this patent is extended or adjusted under 35 U.S.C. 154(b) by 184 days.

This patent is subject to a terminal disclaimer.

(21) Appl. No.: 10/817,853

(22) Filed: Apr. 6, 2004

(65) Prior Publication Data

US 2004/0200712 A1 Oct. 14, 2004

(30) Foreign Application Priority Data

| | | |
|---|---|---|
| Apr. 11, 2003 | (JP) | 2003-141190 |
| Apr. 18, 2003 | (JP) | 2003-114833 |
| Aug. 11, 2003 | (JP) | 2003-291736 |
| Nov. 5, 2003 | (JP) | 2003-375581 |

(51) Int. Cl.
*H01H 9/00* (2006.01)

(52) U.S. Cl. ..... 200/314; 200/341

(58) Field of Classification Search ..... 200/512–517, 200/520, 341–345, 5 A, 5 R, 310–314; 345/268; 400/471–472

See application file for complete search history.

(56) References Cited

U.S. PATENT DOCUMENTS

| | | | | |
|---|---|---|---|---|
| 4,732,724 A | 3/1988 | Sterner | | |
| 5,557,079 A * | 9/1996 | Jackson et al. | 200/5 A | |
| 5,661,279 A * | 8/1997 | Kenmochi | 200/314 | |
| 6,180,895 B1 * | 1/2001 | Hutchinson et al. | 200/5 A | |
| 6,259,044 B1 * | 7/2001 | Paratore et al. | 200/5 A | |
| 6,835,906 B2 * | 12/2004 | Okamoto et al. | 200/341 | |
| 6,928,297 B2 * | 8/2005 | Kitamura et al. | 455/550.1 | |
| 7,034,235 B2 * | 4/2006 | Hosaka | 200/314 | |

FOREIGN PATENT DOCUMENTS

| | | |
|---|---|---|
| CN | 1425970 A | 6/2003 |
| EP | 0 845 795 A2 | 6/1998 |
| EP | 1 139 364 A2 | 10/2001 |
| JP | 2000-010710 | 1/2000 |
| JP | 2003-178639 | 6/2003 |
| JP | 2004-319396 | 11/2004 |
| JP | 2004-327417 | 11/2004 |
| JP | 2004-327420 | 11/2004 |

OTHER PUBLICATIONS

Office Action, Feb. 2, 2007.

* cited by examiner

*Primary Examiner*—Richard K. Lee
(74) *Attorney, Agent, or Firm*—Rader, Fishman & Grauer PLLC

(57) ABSTRACT

A key sheet includes a base sheet and a plurality of key tops arranged on the base sheet and exposed from an operation opening formed in a case of a device. The operation opening has no partition bridge. The base sheet includes a plurality of bases for fixing the key tops and a reinforcing member for supporting the bases while allowing displacement upon pushing.

17 Claims, 32 Drawing Sheets

KEY SHEETS AND METHOD OF PRODUCING THE SAME

BACKGROUND OF THE INVENTION

1. Field of the Invention

The present invention relates to a key sheet for push-button switches to be used in an operation section of various kinds of devices such as a mobile phone, a PDA, a car navigation system, and a car audio system. In particular, the present invention relates to a key sheet suitable for the use of a plurality of key tops from an operation opening formed in the case of the device with no partition bridge.

2. Description of the Related Art

Like a mobile phone 1 shown in FIG. 32, due to a desire for miniaturization of the whole device or an operation section thereof and a desire for design performance, and so on, it has been desired to provide push-button switches such that plural key tops 3 of a key sheet 2 are narrowly arranged and exposed from an operation opening 1*b* formed in a case 1 a with no partition bridge. As shown in FIG. 33, the key sheet 2 of the related art is constructed of a plurality of key tops 3 (i.e., 17 key tops 3 in total) firmly fixed on a base sheet 4 made of silicone rubber. That is, the key sheet 2 includes a large-sized key top 3*a* in the middle upper side for input in upward, downward, right, and left directions in FIG. 33, four small-sized key tops 3*b* located on the left and right sides of the key top 3*a*, and twelve middle-sized key tops 3*c* located below the key tops 3*b*. The distance between the adjacent key tops 3*a*, 3*b*, and 3*c* is extremely narrow. For example, they are narrowly arranged with a distance of about 0.15 mm to 0.2 mm. They are also extremely narrowly spaced from the operation opening 1*b* and the distance is almost the same as the above.

The structure for mounting such a key sheet 2 is constructed such that structural elements inside the case 1*a* (in this prior art, the opening-edge portion of the operation opening 1*b* in the back side 1*c* of the case 1*a* and a circuit board 1*d* built in the case 1*a*) compress and retain completely around the outer edge portions of a base sheet 4. The inside of a pressure-contact portion is provided with an installed structure that does not restrain the case 1*a* and the circuit board 1*d*. Thus, when the key sheet 2 is turned upright as shown in FIG. 35 or is turned upside down as shown in FIG. 36 at the time of using the mobile phone 1, the base sheet 4 made of a rubber-like elastic body such as flexible silicone rubber may be extended and distorted as a whole by the weight loading of the key top 3. When the key sheet 2 is distorted on the whole in this manner, a pusher 4*a* of the base sheet 4 and a contact switch 1*e* constructed of a metal disk spring and a contact circuit in a circuit board 1*d* are displaced from each other. Thus, poor operation such as the impossibility or difficulty in input even by depressing the key top 3 may occur. In addition, depending on the appearance of the distorted base sheet 4, the amount of an input stroke differs for every key top 3, so that it may affect the operational performance. Furthermore, there is a problem in that the mobile phone 1 looks unattractive. Besides, one of the adjacent key tops 3 may slip into the space under the other.

The problems caused by distortion of the base sheet 4 made of the flexible rubber-like elastic body as described above should be solved particularly with respect to the key sheet 2 having all of the narrowly-arranged key tops 3 exposed from the operating opening 1*b* as shown in the figure. However, these problems may occur when one operation opening is formed for the key tops 3*b* located at the upper and lower positions (i.e., when two or more key tops are arranged in a single operation opening). In addition, even when a key sheet with a plurality of narrowly spaced key tops is mounted to a device when in use that is not designed to be turned upright or turned upside down as the mobile phone 1, problems such as slippage of one key top under the adjacent key top may occur as a result of distortion of the base sheet made of a flexible rubber-like elastic body. Therefore, the countermeasure is also demanded about the key sheet.

SUMMARY OF THE INVENTION

The present invention was made against the background of the technology described above. An object of the present invention is to quickly inhibit the distortion of a key sheet having a plurality of narrowly-arranged key tops.

In order to attain the above-mentioned object, according to an aspect of the present invention, there is provided a key sheet including: a base sheet; and a plurality of key tops arranged on the base sheet and exposed from an operation opening formed in a case of a device, the operation opening having no partition bridge, in which the base sheet includes: a plurality of bases for fixing the key tops on the base sheet; and a resin film having through holes to fix the bases thereon by bridging over the bases.

According to the present invention, a resin film having through holes where the respective bases are bridged over and fixed therein, so that the overall rigidity of a base sheet can be improved compared with the conventional base sheet using a rubber-like elastic body such as silicone rubber. The base sheet can be prevented from overall distortion even though a key sheet is turned upright or turned upside down. Therefore, with a device such as a mobile phone or a PDA which is turned upright or turned upside down in use, even though the key sheet is turned upright or turned upside down, it is possible to quickly reduce poor operation caused by the displacement between the key top and the contact switch, a bad feel in manipulation due to an obvious difference in the stroke length of the key tops when pushed, and an adverse effect on the design performance of the device with visual observation.

In the present invention, for example, the overall distortion of the key sheet can be further prevented by the concrete conformation as described below.

In the present invention, the generation of distortion can be prevented by providing on a resin film a reinforcing member that restricts the distortion of a base sheet. As a concrete example of such a reinforcing member, it is possible to construct a resin molded product attached on the resin film. The resin molded product attached on the resin film may be a single molded product or a plurality of molded products where the materials are different from each other. In addition, it is also possible to construct a resin molded product integrally molded with a resin film by die-molding. In this case, it is possible to use as the die-molding insert molding, in-mold molding, or the like. Furthermore, it is also possible to construct a molded product of a liquefied resin applied on the resin film. In this case, the liquefied resin to be used may be selected from reactive-curing resins such as a thermosetting, photo-curing, humidity-curing, and pressurization and humidification curing resins, and nonreactive-curing resins such as a heat-flexible resin.

Furthermore, in the present invention, the base can be formed using a rubber-like elastic body and provided with a flexible portion that displaces when the key tops are pushed down. If the base has a flexible portion, it is possible to realize the switch input performed by displacing the key tops in the direction of pushing owing to the flexible portion of the base, while enhancing the rigidity of the key sheet as a whole.

Furthermore, in the present invention, the base can be formed using a hard resin and the resin film can be provided with a flexible portion that displaces when the key tops are pushed down. If the resin film has a flexible portion, it is possible to realize the switch input performed by displacing the key tops in the direction of pushing owing to the flexible portion of the resin film, while enhancing the rigidity of the key sheet as a whole.

The above resin film of the present invention is constructed such that the overall distortion of the base sheet can be prevented even though the device is turned upright or turned upside down, while a plurality of key tops retained by the respective bases are exposed from an operation opening with no partition bridge formed in the body of the device. In other words, there is a need to satisfy the characteristic features for overcoming at least poor operation caused by the displacement between the key top (the pusher) and the contact switch of the circuit board, a bad feel in manipulation due to a substantial difference between the stroke lengths of the respective key tops when pushed, and a loss of the design performance of the device (i.e., visual observation of apparent evagination of the key sheet from the case of the device). Therefore, if these prescribed properties are satisfied at least, it can be used as a resin film in the present invention irrespective of the hardness or softness or thickness.

More specifically, in the present invention having no reinforcing member between the both ends of the through hole, a resin film which is able to prevent the generation of complete distortion can be used even if a device is turned upright or turned upside down under the conditions that a plurality of key tops are retained on the respective bases from an operation opening having no partition bridge formed on the case of the device.

On the other hand, in the present invention having a reinforcing member between the both ends of the through hole, a resin film which is able to prevent the generation of complete distortion can be used in cooperation with the reinforcing member even if a device is turned upright or turned upside down under the conditions that a plurality of key tops are retained on the respective bases from an operation opening having no partition bridge formed on the case of the device. The resin film is preferably one having enough softness and low rigidity to easily perform a switch input by the pushing of the key top, when the resin film is applied to the present invention in which the base is formed of a hard resin and a flexible portion is formed on the resin film to allow the displacement by pushing. In other words, the resin film of the present invention acts as a flexible portion to be displaced by pushing, rather than as a reinforcing member in view of the complete key sheet. Such a kind of resin film can be easily deformed by pushing the key tops, and allows a switching operation with an appropriate load weight.

Further, according to another aspect of the present invention, there is provided a key sheet including: a base sheet; and a plurality of key tops arranged on the base sheet and exposed from an operation opening formed in a case of a device, the operation opening having no partition bridge, in which the base sheet includes: a plurality of bases made of a rubber-like elastic body for fixing the key tops; and a thin-plate like reinforcing member made of a hard resin for supporting the bases while allowing displacement upon pushing.

According to the key sheet of the present invention, the rigidity of the base sheet is increased by supporting the key tops by the bases and supporting the bases by a thin-plate like reinforcing member made of a hard resin, so that the distortion of the base sheet can be almost or completely dissolved. Therefore, various problems caused by the distortion of the base sheet can be almost or completely resolved. The problems include: poor operation caused by the displacement between the key top and the contact switch; a bad feel in manipulation due to a substantial difference between the stroke lengths of the respective key tops when pushed; a loss of the design performance of the device; and slippage of one key top under the other.

In the key sheet according to the present invention having a thin-plate like reinforcing member or having a reinforcing member on a resin film, there can be used as a reinforcing member thereof a heat-resistant hard resin having a deflection temperature under load of 170° C. or more measured on the basis of Japan Industrial Standard JIS K 7191.

The reinforcing member was prepared using a heat-resistant hard resin having a deflection temperature under load of 170° C. or more, which is measured on the basis of Japan Industrial Standard JIS K 7191, so that the rigidity of the base sheet was increased. In addition, it is hardly affected by thermal deformation and a key sheet having good dimensional accuracy without warping can be obtained. Note that JIS K 7191 describes a method of determining the testing method for a deflection temperature under load. Therefore, unless otherwise specified, the term "deflection temperature under load" is a deflection temperature under load measured on the basis of JIS K 7191.

The hard resin may include a heat-resistant hard resin selected from the group consisting of a polyacrylate resin, a polyallylsulfonate resin, a polyethersulfonate resin, and a polysulfonate resin.

Using these resins, because of their rigidity and excellent heat resistance, thermal deformation can be prevented at the time of molding or removing from a die, when the base made of a reinforcing member and a rubber-like elastic body are integrally formed by die-molding, for example. Thus, a key sheet having high dimensional accuracy can be obtained. In addition, if an illuminating-type key sheet is to be obtained, the transparency of the material itself is high when the resin used is transparent. Therefore, there is provided an illuminating-type key sheet having excellent illumination property with good transparency of light from an internal light source.

Further, the hard resin may include a heat-resistant polycarbonate resin including a constitutional unit represented by the following general formula (1):

General Formula (1)

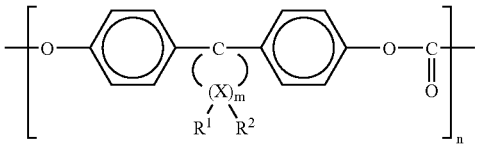

(where X represents a carbon atom and m represents an integer of 4 to 7, $R^1$ and $R^2$ may be individually selected for each X, and each independently represents a hydrogen atom or an alkyl group having 1 to 6 carbon atoms, and n represents an integer of 40 to 100).

Using this resin, because of its rigidity and excellent heat resistance, thermal deformation can be prevented at the time of molding or removing from a die, when the base made of a reinforcing member and a rubber-like elastic body are integrally formed by die-molding, for example. Thus, a key sheet having high dimensional accuracy can be obtained. In addition, if an illuminating-type key sheet is to be obtained, the transparency of the material itself is high when the resin used is transparent. Therefore, there is provided an illuminating-type key sheet having excellent illumination property with good transparency of light from an internal light source.

Further, the hard resin that constitutes the reinforcing member may contain a resin reinforcement.

According to the present invention, the rigidity of the hard resin is extensively improved, so that the base sheet can be completely prevented from distortion.

The resin reinforcements to be used in the present invention include scaly resin reinforcements, soil massive resin reinforcements, fibrous resin reinforcements, and globular resin reinforcements.

If one of these resin reinforcements is used, it can be easily filled in the hard resin, the workability of the hard resin after molding is good, and a high reinforcing effect can be obtained. The scaly resin reinforcements include mica powders and graphite powders, the soil massive resin reinforcements include graphite powders, and the globular resin reinforcements include glass balls and silica balls. Moreover, the fibrous resin reinforcements include the following:

That is, the resin reinforcement of the present invention may contain at least one selected from the group consisting of a glass fiber, a metal fiber, a carbon fiber, an aramid fiber, and a ceramic fiber.

These fibers have an excellent effect on an improvement in rigidity and have an excellent heat resistance. Thus, thermal deformation of a hard resin that constitutes the reinforcing member can be prevented at the time of molding or removing from a die, when the base made of a reinforcing member and a rubber-like elastic body are integrally formed by die-molding, for example. As a result, a key sheet having high accuracy can be obtained.

A concrete configuration of the above key sheet contains bases made of a rubber-like elastic body on a reinforcing member, and the whole base sheet is the reinforcing member as a substrate. Alternatively, the configuration of the key sheet contains an elastic sheet as a substrate which is made of a rubber-like elastic body where the whole base sheet is made of silicone rubber, thermoplastic elastomer, or the like.

That is, in the key sheet according to the present invention, the reinforcing member is constructed of a single plate in which through holes for bridging over the bases to fix the bases thereon.

According to the present invention, the reinforcing member is constructed of a single plate, so that the rigidity of the reinforcing member can be increased as a whole and the overall distortion of the key sheet can be prevented. In this case, the fixing between the through hole of the reinforcing member and the base can be realized by integral molding with die-molding or adhesion with an adhesive. Here, the integral molding with die-molding allows an increase in strength of fixing and productivity.

Further, in the key sheet according to the present invention, the base sheet is formed of an elastic sheet made of a rubber-like elastic body having bases, and the reinforcing member is partially mounted between the adjacent bases.

According to the present invention, the base sheet is formed of an elastic sheet while an improvement in rigidity of a reinforcing member formed between adjacent bases completely prevents the key sheet from distortion. In this case, the reinforcing member can be provided by integral molding with an elastic sheet with die-molding, adhesion to the elastic sheet, the application of a liquefied resin to serve as a reinforcing member, or the like, followed by curing of the resins.

In the key sheet according to the present invention described above, the base sheet is formed of an elastic sheet made of a rubber-like elastic body having bases, and the reinforcing member is mounted on the outer edge portion of the elastic sheet.

According to the present invention, the base sheet is formed of an elastic sheet while an improvement in rigidity of an elastic sheet made of a reinforcing member at an outer edge allows to completely prevent the key sheet from distortion. In this case, the reinforcing member can be provided by integral molding with an elastic sheet with die-molding, adhesion to the elastic sheet, the application of a liquefied resin to serve as a reinforcing member, or the like, followed by curing of the resins.

In the key sheet according to the present invention described above, a pressure-contact portion made of a rubber-like elastic body is formed on the base sheet.

According to the present invention, the key sheet can be retained in the device by retaining a pressure-contact portion made of a rubber-like elastic body after compression thereof, owing to the impact resilience of the pressure-contact portion.

Further, according to another aspect of the present invention, there is provided a method of manufacturing a key sheet in which a plurality of key tops are exposed from an operation opening having no partition bridge formed in a case of a device and are fixed on a base sheet, including: preparing a reinforcing member using a heat-resistant hard resin having a deflection temperature under load of 170° C. or more measured on the basis of Japan Industrial Standard JIS K 7191; transferring the reinforcing member to a cavity of a die for molding the base sheet; and producing the base sheet by charging a rubber-like elastic body into the cavity and integrally combining the rubber-like elastic body and the reinforcing member at temperatures lower than the deflection temperature under load of the heat-resistant hard resin.

According to the present invention, using a heat-resistant hard resin having an excess deflection temperature of 170° C. measured on the basis of JIS K 7191 is used for the production of a reinforcing member. Then, the reinforcing member is transferred to the cavity of a die for molding a base sheet, followed by charging a rubber-like elastic body into the cavity. Subsequently, a base sheet is manufactured by integrally combining the rubber-like elastic body and the reinforcing member at a temperature lower than the deflection temperature under load of the heat-resistant hard resin. Therefore, the reinforcing member is hardly deformed by heat at the time of integral molding of the rubber-like elastic body and the reinforcing member and at the time of removing from a die, and a key sheet having high dimensional accuracy can be obtained. Then, selecting the resin having the predetermined deflection temperature under load or more facilitates the production of a die for manufacturing a reinforcing member because of no need to prepare a plurality of dies for manufacturing a reinforcing member so as to correspond to the different kinds of resins in consideration of the degree of "warping" in advance according to the kinds of resins and no need of complicate design of the die in consideration of the degree of "warping". Consequently, costs for manufacturing the die can be reduced.

When a thermosetting elastomer is used as the rubber-like elastic body, the base sheet can be produced by integrally combining the thermosetting elastomer and the reinforcing member at temperatures not lower than a curing temperature of the thermosetting elastomer but lower than the deflection temperature under load of the heat-resistant hard resin.

According to the present invention, a thermosetting elastomer and a reinforcing member are integrally combined at temperatures equal to or higher than the curing temperature of the thermosetting elastomer and lower than the deflection temperature under load of the heat-resistant hard resin to be used for the reinforcing member. Thus, even if the thermosetting elastomer is heated at temperatures enough to cure the thermosetting elastomer with crosslinking (vulcanization) in a molding die, there is no thermal deformation found in the reinforcing member as the temperature is lower than the deflection temperature under load of the heat-resistant hard resin. Consequently, a key sheet having no thermal deformation such as warping can be obtained without influencing the curing temperature of the thermosetting elastomer.

When the rubber-like elastic body is silicone rubber, the base sheet can be produced by integrally combining the silicone rubber and the reinforcing member at temperatures not lower than 160° C. but lower than the deflection temperature under load of the heat-resistant hard resin used as the reinforcing member.

According to the present invention, silicone rubber and a reinforcing member are integrally combined at temperatures of 160° C. or more but lower than the deflection temperature under load of the heat-resistant hard resin used for the reinforcing member. Thus, even if the silicone rubber is heated to the temperature of 160° C. or more, which is enough to cure the silicon resin by crosslinking, the reinforcing member does not suffer thermal deformation because the temperature is lower than the deflection temperature under load of the heat-resistant hard resin. Therefore, it does not affect the curing temperature of the silicone rubber, so that a key sheet can be obtained without any deformation by heat such as warping.

As described above, according to the key sheet of any one of the above aspects of the present invention, the rigidity of the base sheet is increased owing to the above construction of the reinforcing member, so that the distortion of the base sheet can be suppressed, almost dissolved, or completely dissolved. Therefore, in the key sheet according to the present invention, various problems caused by the distortion of the base sheet can be almost or completely. The problems include: poor operation caused by the displacement between the key top and the contact switch; a bad feel in manipulation due to a substantial difference between the stroke lengths of the respective key tops when pushed; a loss of the design performance of the device; and slippage of one key top under the other.

In particular, when a hard resin to serve as a reinforcing member contains a resin reinforcement, a remarkable increase in rigidity of the hard resin is attained and the base sheet can be completely prevented from distortion. Furthermore, the resin reinforcement may contain at least one of a glass fiber, a metal fiber, a carbon fiber, an aramid fiber, and a ceramic fiber. In this case, the thermal deformation of the hard resin (which constitutes the reinforcing member) that tends to occur at the time of molding or removing from a die can be prevented, in addition to the effect of improving the rigidity. Consequently, the high-precision key sheet is obtained and thus the mass-production of the key sheet can be attained with sufficient yield even if it is the key sheet of a complicated design form.

Furthermore, when a heat-resistant hard resin having a deflection temperature under load of 170° C. or more is used as a hard resin to serve as a reinforcing member, it is possible to reduce the manufacturing cost because there is no thermal deformation in the process of manufacturing a key sheet and the resulting key sheet has high dimensional accuracy.

Furthermore, according to the method of manufacturing a key sheet of the present invention, there is no need to consider the thermal deformation (e.g., warping) of the key sheet and a key sheet having high dimensional accuracy can be obtained, while allowing the production an inexpensive key sheet with high quality.

As described above, the key sheet of the present invention will solve problems resulting from the distortion of the base sheet. Therefore, it is possible to respond to the demand of miniaturizing the whole device and the operation part thereof, without depending on a method that affects operability in which the size of a key top itself is reduced.

It should be recognized that the above description does not limit the scope of the present invention, and the purposes, advantages, and uses of the present invention will be clarified by the following description with reference to the attached figures. Moreover, it should be understood that any appropriate modification will be included in the scope of the present invention.

EMBODIMENTS OF THE INVENTION

Figure 1:
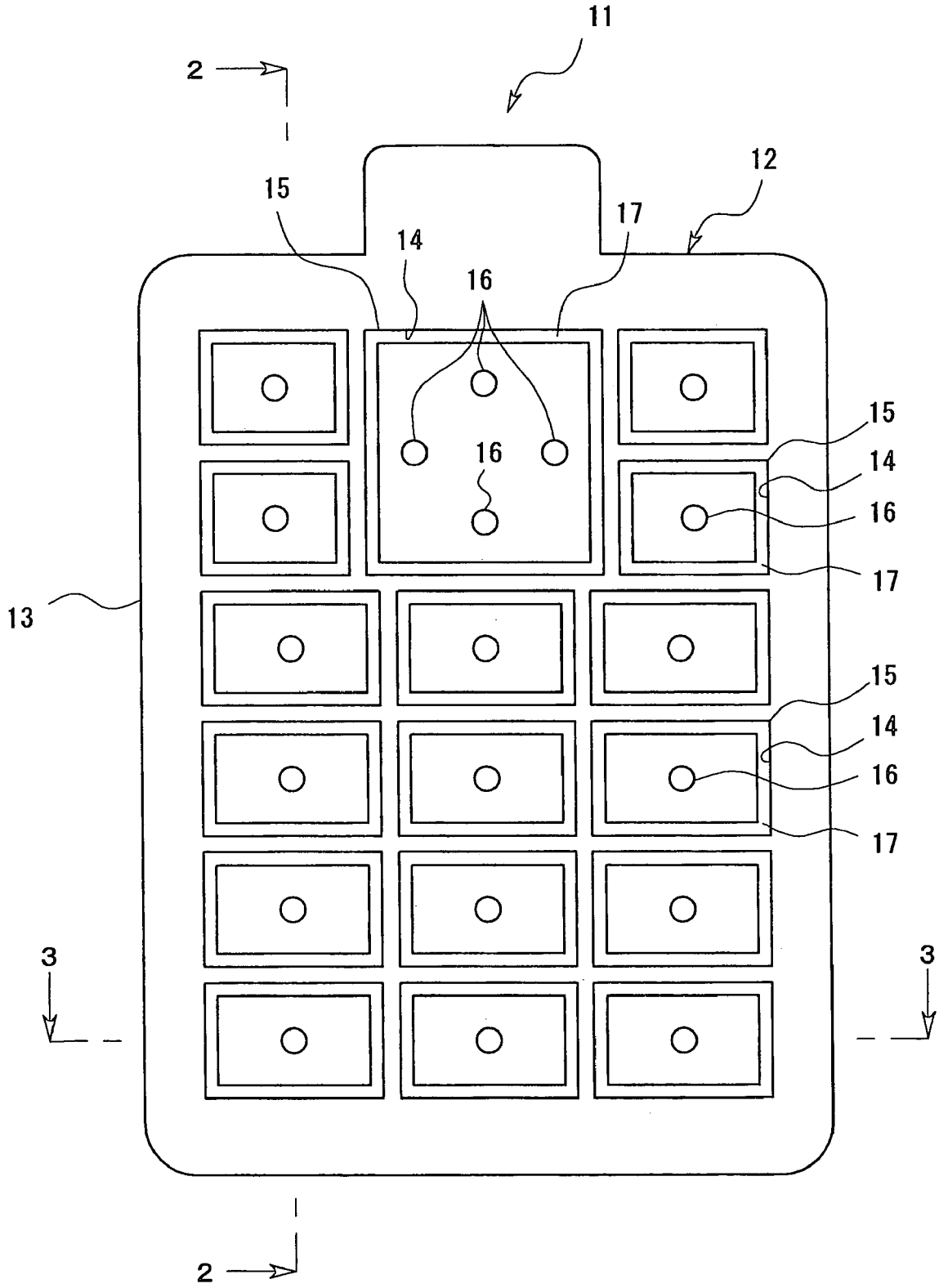
FIG. 1 is an external view of the bottom surface of a key sheet according to a first embodiment of the present invention.

Hereinafter, the embodiments of the present invention will be described with reference to the attached drawings. Here, the structural components common to those of the related art and the structural components common to those of the respective embodiments will be represented by the same reference numerals to omit duplicated explanations. In the following description, an exemplified key sheet for push-button switches to be used in a mobile phone 1 as an "apparatus" just as in the case of the description of the related art.

Figure 2:
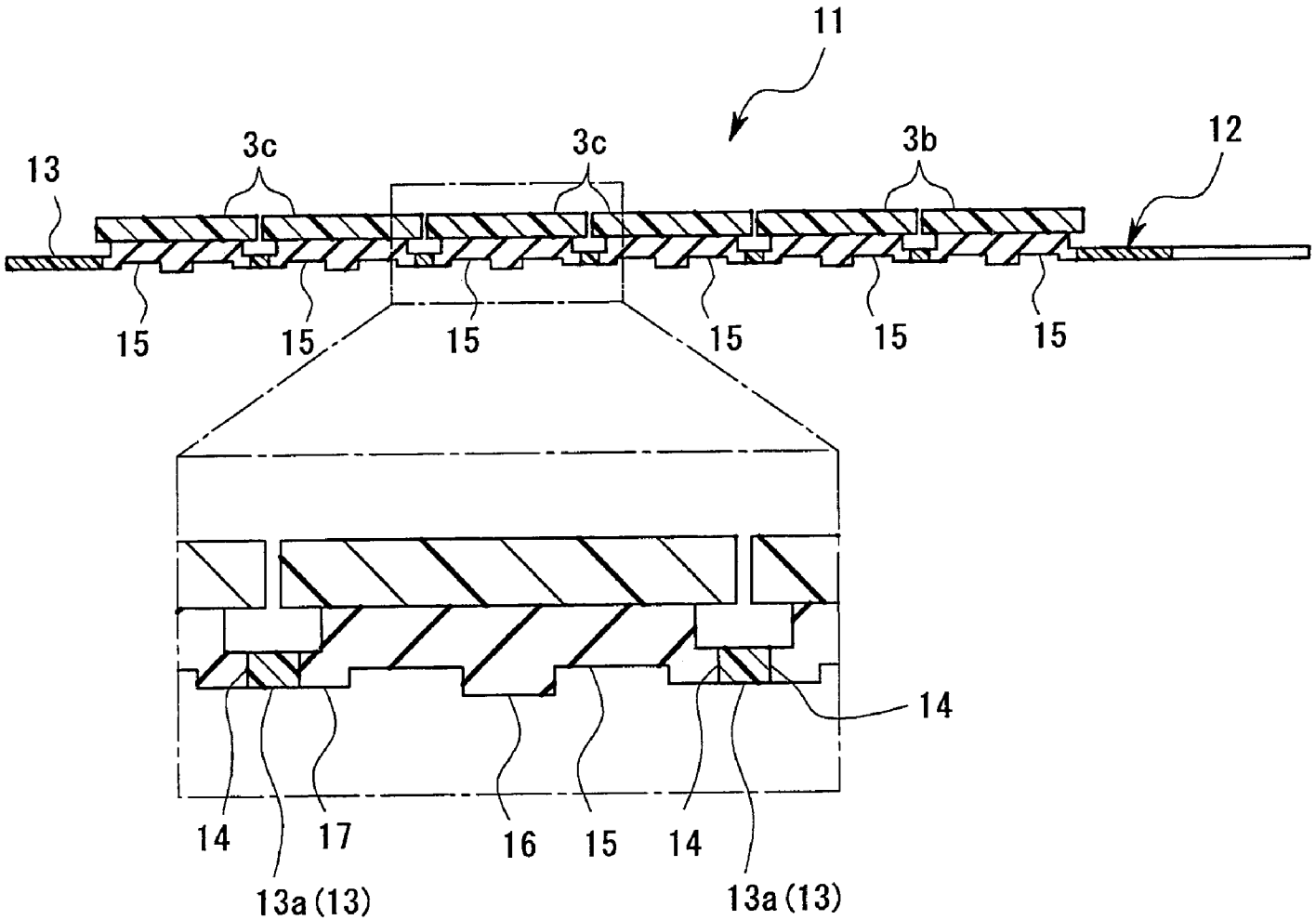
FIG. 2 is a sectional view taken along the line 2—2 of FIG. 1.
Figure 3:
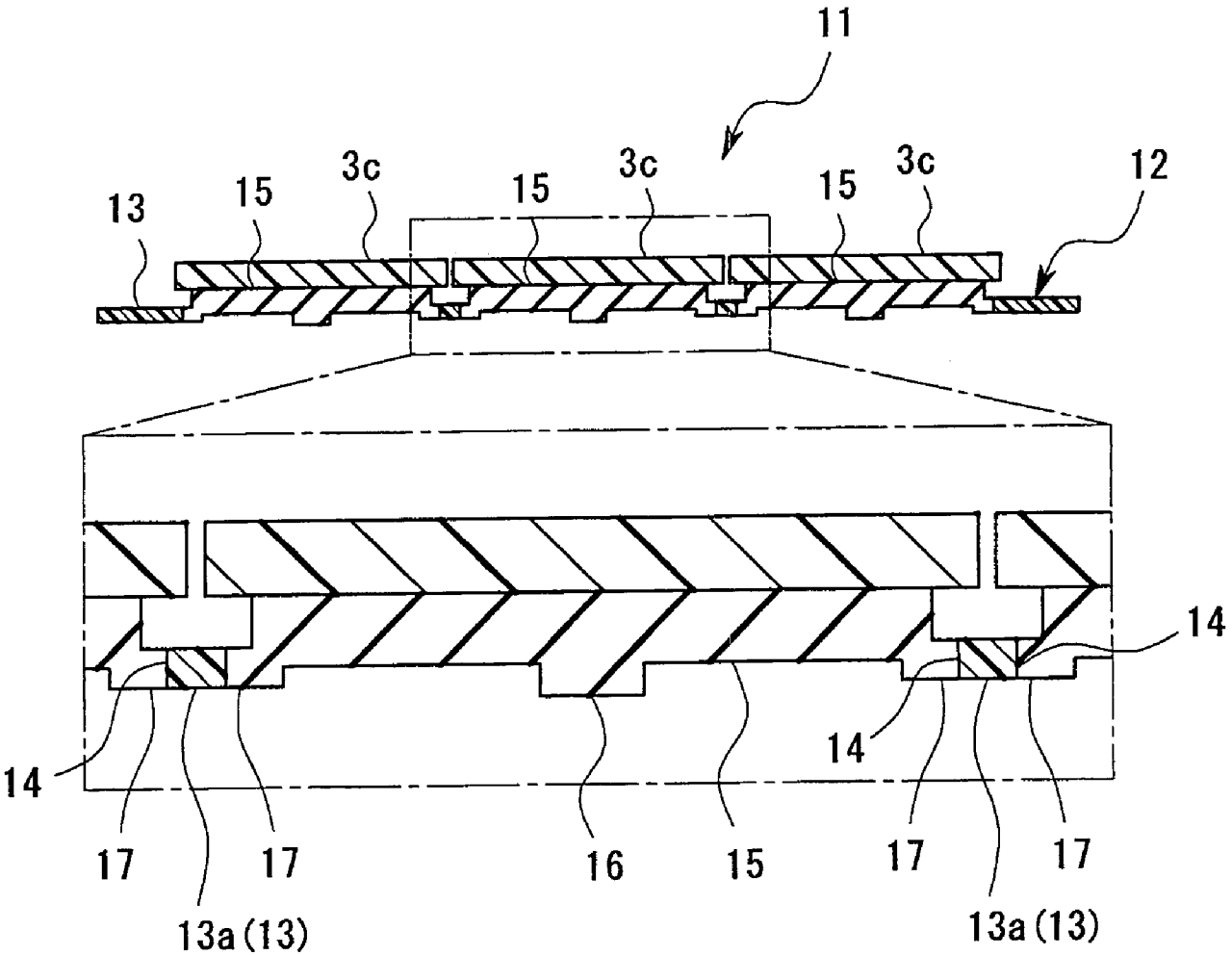
FIG. 3 is a sectional view taken along the line 3—3 of FIG. 1.

First Embodiment (FIGS. 1 to 3)

A key sheet 11 of this embodiment is constructed of a base sheet 12 and key tops 3 fixed on the base sheet 12. The key sheet 11 of the first embodiment is illustrated in FIGS. 1 to 3. FIG. 1 is an external view of the bottom surface of the key sheet 11 according to the first embodiment. FIG. 2 is a sectional view taken along the line 2—2 of FIG. 1. FIG. 3 is a sectional view taken along the line 3—3 of FIG. 1.

The base sheet 12 is provided with a sheet of a hard resin plate 13 as a "reinforcing member". The hard resin plate 13 is of a rectangular shape having rounded corners and a rectangular tongue portion on the upper side thereof. The hard resin plate 13 has bridges 13*a* in the form of a lattice to provide rectangular through holes 14 corresponding to the portions where the respective key tops 3 are formed. Each through hole 14 is closed by a base 15 made of a rubber-like elastic body. As shown in each of the enlarged cross sections of FIGS. 2 and 3, the base 15 has the corresponding key top 3 fixed on the upper surface thereof with an adhesive (not shown) and a downwardly-extended cylindrical pusher 16 on the bottom surface thereof. Further, formed on the base 15 is a flexible portion 17 that shows a rubber elastic change by pushing the key top 3. The flexible portion 17 keeps the key top 3 in a floating condition to allow the pusher 16 of the key top 3 to be displaced by pushing the key top 3 downward in the figure.

Here, the material of each part constituting the base sheet 12 will be described. Firstly, a material of high rigidity is used for the hard resin plate 13 to suppress the distortion of the key sheet 11. Examples of the material which may be used for the hard resin plate 13 include polycarbonate resins, polymethyl methacrylate resins, polypropylene resins, polystyrene resins, polyacrylic copolymer resins, polyolefin resins, acrylonitrile butadiene styrene resins, polyester resins, epoxy resins, polyurethane resins, polyimide resins, polyamide resins such as polyamideimide resins, silicone resins, amino resins such as melamine resins, allyl resins, furan resins, phenol resins, fluorine resins, polyallylate resins, polyallyl sulfone resins, polyether sulfone resins, polyphenylene ether resins, polyphenylene sulfide resins, and polysulfone resins.

Of those resins, heat-resistant hard resins each having a deflection temperature under load of 170° C. are preferably used in order to prevent deformation such as warping of the hard resin plate 13 when the plate is heated during the manufacture of the base sheet 12. Examples of such resins include: an amino resin having a deflection temperature under load of 180° C.; a melamine resin having a deflection temperature under load of 180° C.; an allyl resin having a deflection temperature under load of 200° C.; an epoxy resin having a deflection temperature under load of 230° C.; a furan resin having a deflection temperature under load of 170° C.; a phenol resin having a deflection temperature under load of 200° C.; a silicone resin having a deflection temperature under load of 300° C.; a fluorine resin having a deflection temperature under load of 200° C.; a polyamide-imide resin having a deflection temperature under load of 270° C.; a polyallylate resin having a deflection temperature under load of 175° C.; a polyallyl sulfone resin having a deflection temperature under load of 204° C.; a polyether sulfone resin having a deflection temperature under load of 200° C.; a polyimide resin having a deflection temperature under load of 240° C.; a polyphenylene ether resin having a deflection temperature under load of 172° C.; a polyphenylene sulfide resin having a deflection temperature under load of 260° C.; a polysulfone resin having a deflection temperature under load of 175° C.; and a polycarbonate resin having a deflection temperature under load of 180° C. Further, of those resins, more preferably used is, for example, a polycarbonate resin containing a constitutional unit represented by the general formula (1) below, a polyallylate resin, a polyallyl sulfone resin, a polyether sulfone resin, or a polysulfone resin. The reasons that a polycarbonate resin containing a constitutional unit represented by the general formula (1) below and the like are preferable are as follows. First, those resins have deflection temperatures under load of 170° C. or higher and do not undergo thermal deformation at the crosslinking temperatures of many resins containing silicone rubber. Second, the adhesive strength between each of the resins and a rubber-like elastic body is high. Third, because the transparency of the resins is high, in the case of a so-called illuminating-type key sheet which illuminates by means of an interior light source, light from the light source can be efficiently emitted.

General Formula (1)

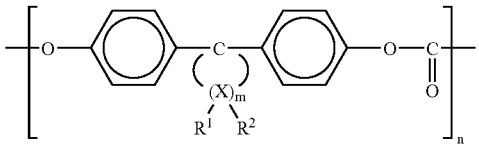

(where X represents a carbon atom and m represents an integer of 4 to 7, $R^1$ and $R^2$ may be individually selected for each X, and each independently represents a hydrogen atom or an alkyl group having 1 to 6 carbon atoms, and n represents an integer of 40 to 100).

Constitutional units each represented by the general formula (1) includes constitutional units represented by the following formulae (2) to (4).

Formula (2)

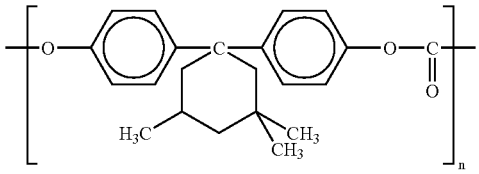

Formula (3)

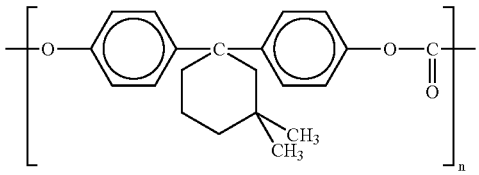

Formula (4)

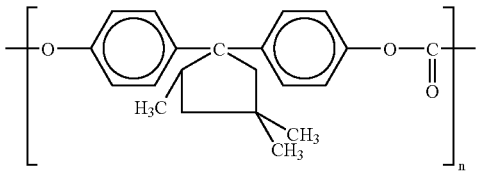

(in each formula, n represents an integer of 40 to 100).

The content of each of the constitutional units represented by the general formula (1) and the formulae (1) to (4) is in the range of 40 to 100% by mole with respect to the whole of a polycarbonate resin. In addition, the end of the general formula (1) or the end of each of the formulae (1) to (4) is bound to H, OH, OR, COOR (R is a hydrogen atom or an alkane having 1 to 3 carbon atoms), or the like depending on the kinds of raw materials.

On the other hand, a hard resin to serve as a base material of the hard resin plate 13 can be mixed with a resin reinforcement. The hard resin to serve as a base material may be the above heat-resistant hard resin or one of the resins described above except of the heat-resistant hard resins, which have been generally used in the art. The resin reinforcement is substantially uniformly dispersed in the hard resin plate 13 after curing, resulting in an improvement in rigidity of the whole surface of the hard resin plate 13.

Examples of such resin reinforcements used include: scaly resin reinforcements such as mica powders and graphite powders; clodded resin reinforcements such as graphite powders; fibrous resin reinforcements such as a glass fiber, carbon fiber, aramid fiber, ceramic fiber, and metal fiber; and spherical resin reinforcements such as glass bulbs and silica bulbs. By using those resin reinforcements, they are easily filled into an uncured liquefied hard resin, the processability of a hard resin molded product after curing is good, and a high reinforcing effect can be achieved.

Of the above resin reinforcements, the resin reinforcement of the present invention preferably contains at least one selected from the group of a glass fiber, a metal fiber, a carbon fiber, an aramid fiber, and a ceramic fiber. This is because of the following reason. Each of those fibers has an excellent effect on an improvement in rigidity and has an excellent heat resistance. Thus, thermal deformation of the hard resin plate 13 which can easily occur at the time of molding or removing from a die can be prevented, for example, when the hard resin plate 13 and the base 15 made of a rubber-like elastic body are integrally formed by die-moulding. As a result, a key sheet 11 having high accuracy can be obtained.

The loading weight of the resin reinforcement as described above varies depending on the shape and raw material of the selected resin reinforcement. For instance, the loading weight of the resin reinforcement in the shape of scale, clod, sphere, or the like is preferably in the range of 15 to 60 parts by weight with respect to 100 parts by weight of the hard resin. In addition, the loading weight of a fibrous resin reinforcement is preferably in the range of 10 to 40 parts by weight with respect to 100 parts by weight of the hard resin because of the following reasons. If each loading weight is less then the lower limit of the above numerical values, a high reinforcement effect cannot be obtained and slight distortion due to insufficient rigidity of the hard resin to serve as a base material may occur. If each loading weight exceeds the upper limit of the above numeral values, it becomes extremely difficult to load a resin reinforcement in a hard resin to serve as a base material and the time period required for mixing and processing is prolonged, resulting in reduced production efficiency. Besides, at the time of forming the hard resin plate 13, the composition of the hard resin, which is charged with the resin reinforcement beyond the upper limit, shows poor flowability and is difficult to be processed into a desired shape.

Examples of the rubber-like elastic body used for the base 15 include: thermosetting elastomers, which have good rebound resilience and flexibility, such as silicone rubber, isoprene rubber, ethylene propylene rubber, butadiene rubber, chloroprene rubber, and natural rubber; and thermoplastic elastomers such as a styrene thermoplastic elastomer, ester thermoplastic elastomer, urethane thermoplastic elastomer, olefin thermoplastic elastomer, amide thermoplastic elastomer, butadiene thermoplastic elastomer, ethylene-vinyl acetate thermoplastic elastomer, fluorine rubber thermoplastic elastomer, isoprene thermoplastic elastomer, and chlorinated polyethylene elastomer. Of those, if silicone rubber, a styrene thermoplastic elastomer, and an ester thermoplastic elastomer are used, the base 15 having superior rebound resilience and high durability can be achieved.

For making the base sheet 12 as described above, the hard resin plate 13 is prepared in advance by die-molding such as injection molding. When a thermosetting elastomer is selected as a rubber-like elastic body that forms the base 15, the thermosetting elastomer is transferred and mounted in the cavity of a molding die and subjected to die-molding. When a thermoplastic elastomer is selected, the thermoplastic elastomer is transferred and mounted in the cavity of an injection molding die and subjected to die-molding. Consequently, a base sheet 12 integrally molded with the base 15 is obtained. In stead of this manufacturing method, the hard resin plate 13 and the base 15 can be molded by coinjection molding.

For integrally molding the hard resin plate 13 and a rubber-like elastic body in the cavity of a die for molding a rubber-like elastic body, a rubber-like elastic body made of silicone rubber or the like is used. In this case, the rubber-like elastic body in the cavity should be heated up to not lower than 150° C. or, in some cases, heated up to 160° C. or more to allow crosslinking (vulcanization). In that case, when the hard resin plate 13 has a low deflection temperature under load, the plate may be deformed by heat to distort the base sheet 12 out of shape, resulting in the so-called "warped" base sheet 12. Therefore, the deflection temperature under load of the resin used for the hard resin plate 13 is preferably equal to or higher than the crosslinking temperature of the rubber-like elastic body, more preferably 170° C. or more. This is because a deflection temperature under load of 170° C. or more increases the freedom of temperature-setting in the manufacturing process because the crosslinking temperatures of various kinds of rubber-like elastic bodies are lower than 170° C. The molding temperature for the production of the base sheet 12 should be defined in consideration of the combination of the hard resin and the rubber-like elastic body selected. However, when a thermosetting elastomer is used for the rubber-like elastic body, it is preferable that the molding temperature be not lower than the curing temperature of the thermosetting elastomer but lower than the deflection temperature under load of the hard resin used for the hard resin plate 13. In addition, when silicone rubber is used for the rubber-like elastic body, it is preferable that the molding temperature be not lower than 160° C. but lower than the deflection temperature under load of the hard resin used for the hard resin plate 13.

After the production of the base sheet 12, the key sheet 11 of this embodiment can be obtained by bonding predetermined key tops 3 on the respective bases 15.

The key sheet 11 obtained as described above prevents the distortion of the base sheet 12 because the hard resin plate 13 containing the resin reinforcement serves as a substrate and the bases 15 are formed in the respective through holes 14 in the substrate to mount the respective key tops 3 on the bases in a floating condition. In other words, the rigidity of the hard resin plate 13 prevents the overall distortion of the key sheet 11 even when the weights of the key tops 3 are loaded on the hard resin plate 13 by placing the key sheet 11 turned upright or turning upside down. Therefore, the configuration of the key sheet 11 of this embodiment prevents poor operation due to the displacement between the pusher 16 and the contact switch 1*e* of the circuit board 1*d*, bad feel in manipulation due to a difference between the stroke lengths of the respective key tops 3 when pushed, an adverse effect on the design performance of the mobile phone 1, and slippage of one key top under the adjacent key top.

Figure 4:
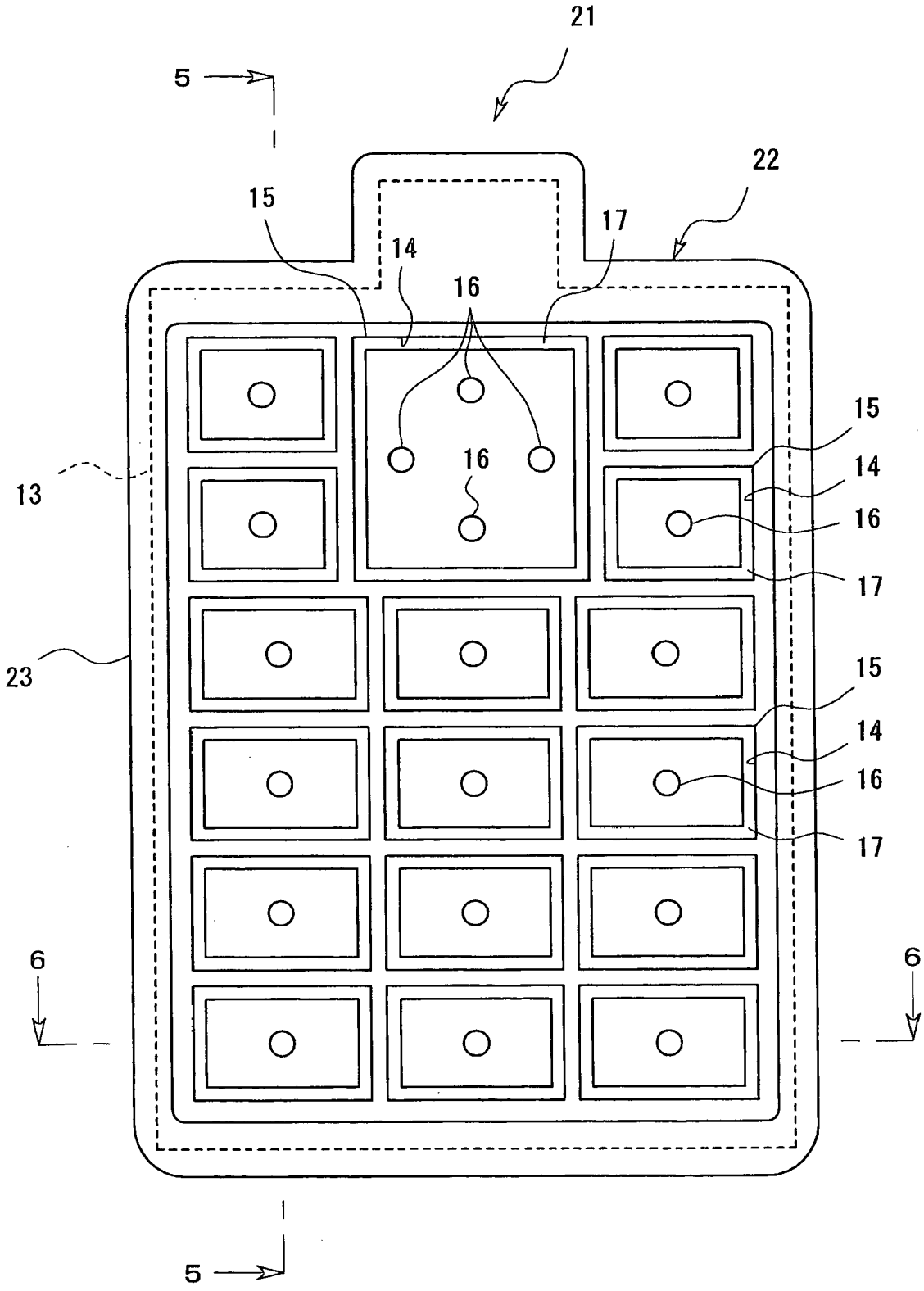
FIG. 4 is an external view of the bottom surface of a key sheet according to a second embodiment of the present invention.
Figure 5:
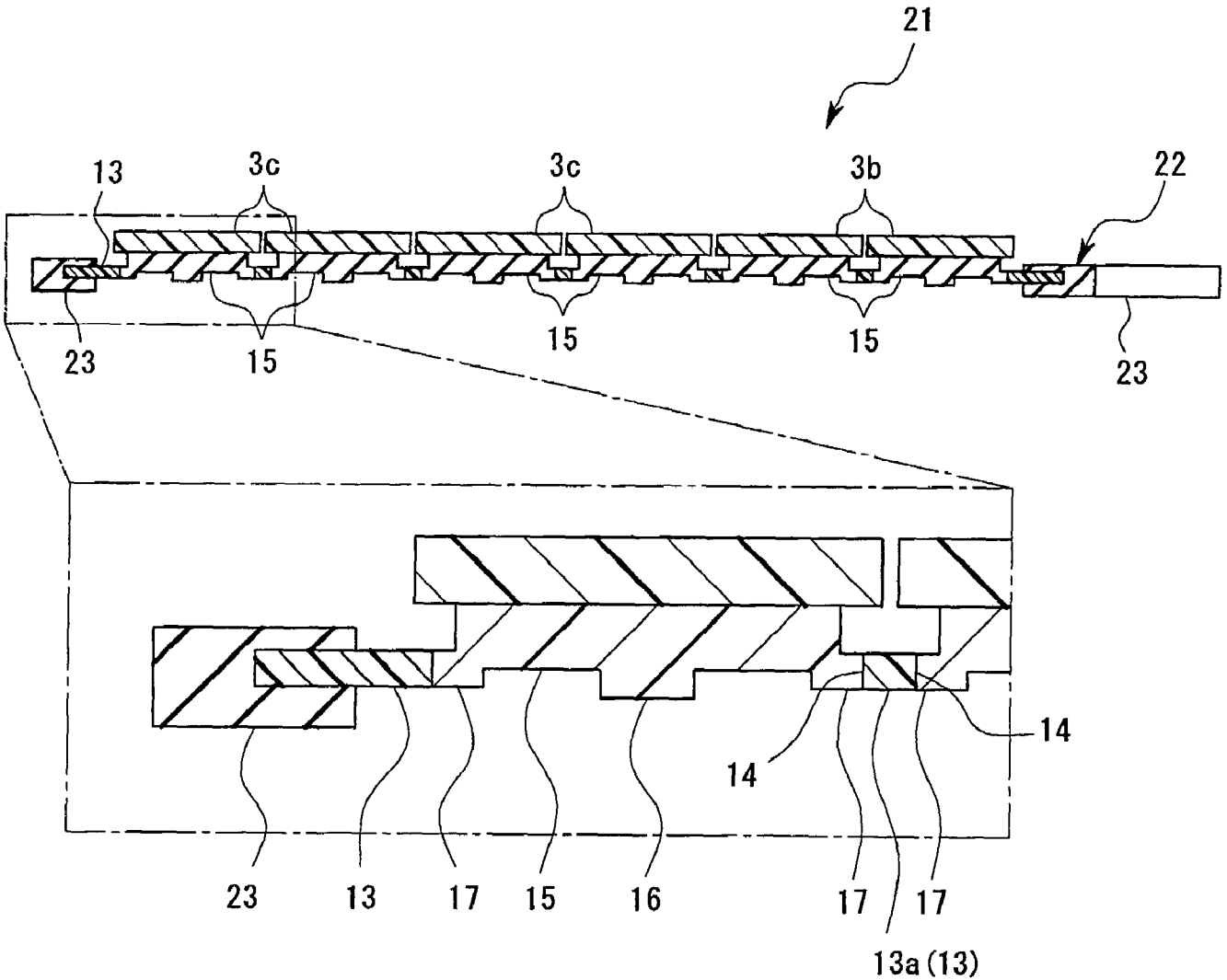
FIG. 5 is a sectional view taken along the line 5—5 of FIG. 4.
Figure 6:
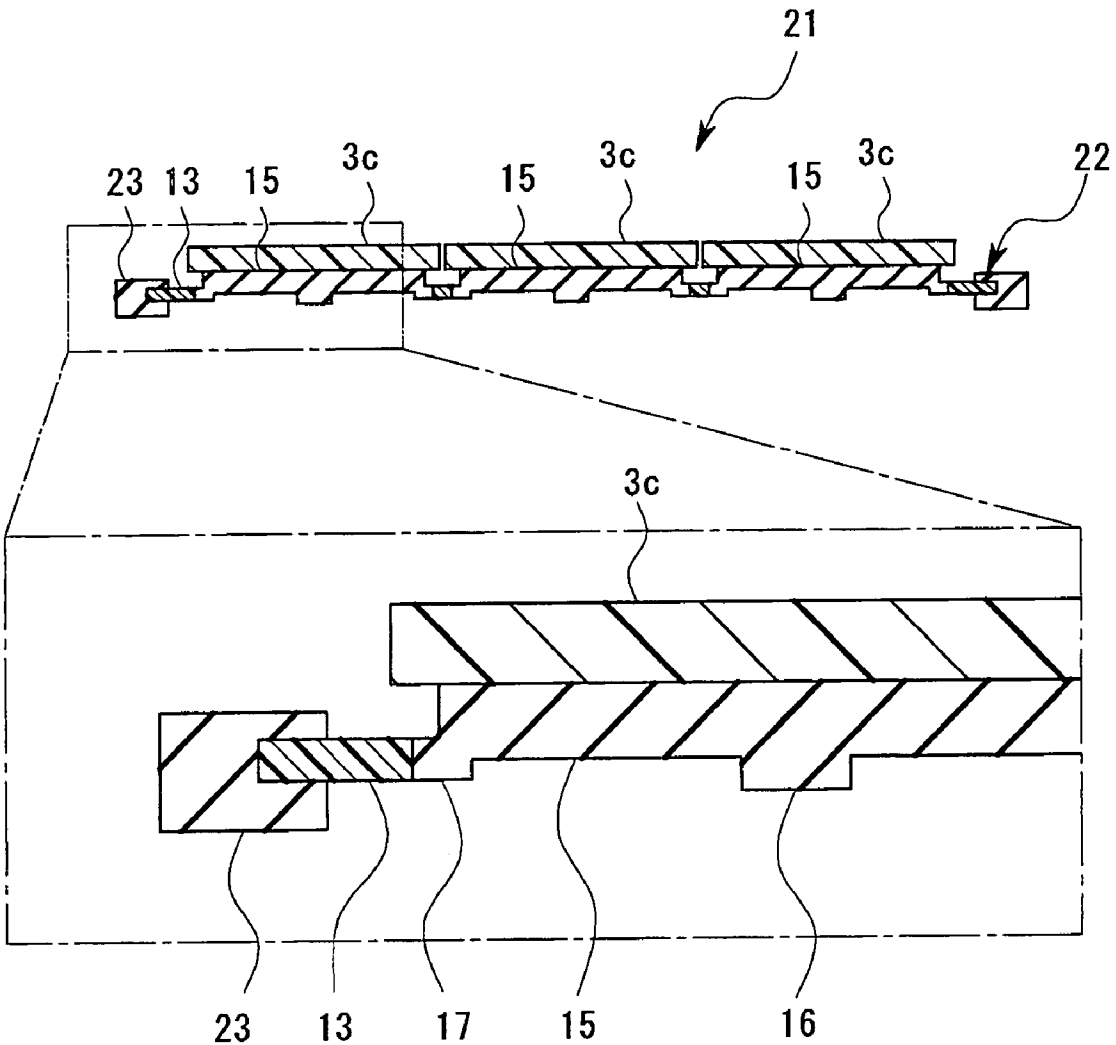
FIG. 6 is an enlarged sectional view taken along the line 6—6 of FIG. 4.

Second Embodiment (FIGS. 4 to 6)

The configuration of a key sheet 21 of this embodiment differs from that of the first embodiment in that a reinforcing outer frame 23 made of a thermoplastic elastomer is integrally molded as a "reinforcing member" and a "pressure-contact portion" with a hard resin plate 13 to serve as a reinforcing member that constitutes a base sheet 22. FIGS. 4 to 6 each illustrate the configuration of the key sheet 21 of the second embodiment. FIG. 4 is an external view of the bottom surface of the key sheet 21 according to the second embodiment, FIG. 5 is a sectional view taken along the line 5—5 of FIG. 4, and FIG. 6 is a sectional view taken along the line 6—6 of FIG. 4. The whole rigidity of the key sheet 21 is improved more than the first embodiment by the formation of the reinforcing outer frame 23 that covers the outer edges of the hard resin plate 13. In addition, the reinforcing outer frame 23 made of the thermoplastic elastomer is excellent in fitting to the surface to be brought into pressure contact therewith by impact resilience when the frame 23 is retained by pressure contact with the portion around the edge of an operation opening 1*b* formed in the back side 1*c* of a case 1*a* of the mobile phone 1 and with a circuit board 1*d* installed in the case 1*a*. Therefore, while strong holding power is exerted, the outstanding sealing performance to the liquid and dust which tend to enter the inside of the case 1*a* from the operation opening 1*b* can be also attained.

The key sheet 21 of the second embodiment can be prepared using the same materials as those used for the key sheet 11 of the first embodiment. In addition, just as in the case of the key sheet 11, the key sheet 21 can be manufactured by die-molding or coinjection-molding.

Figure 7:
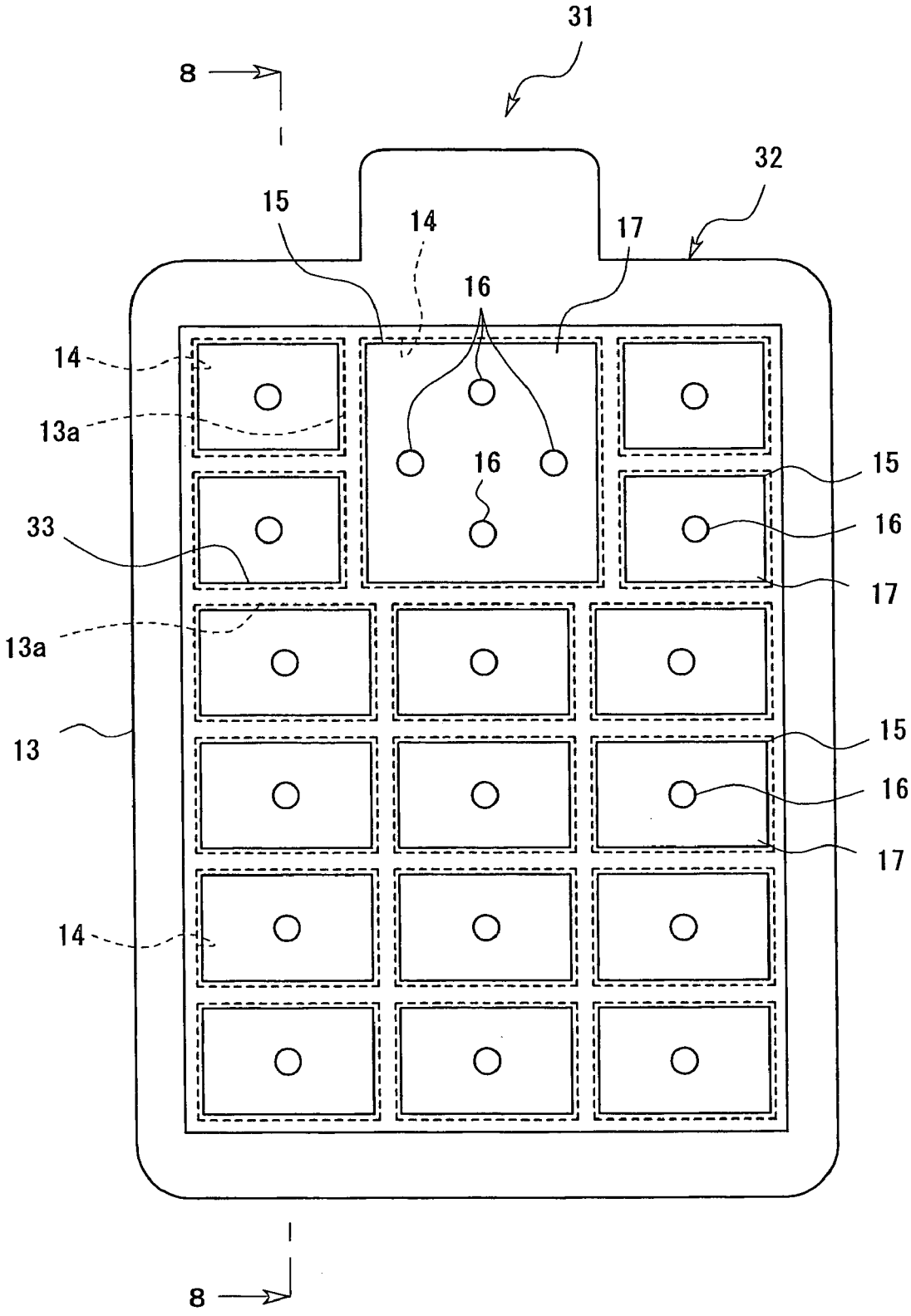
FIG. 7 is an external view of the bottom surface of a key sheet according to a third embodiment of the present invention.
Figure 8:
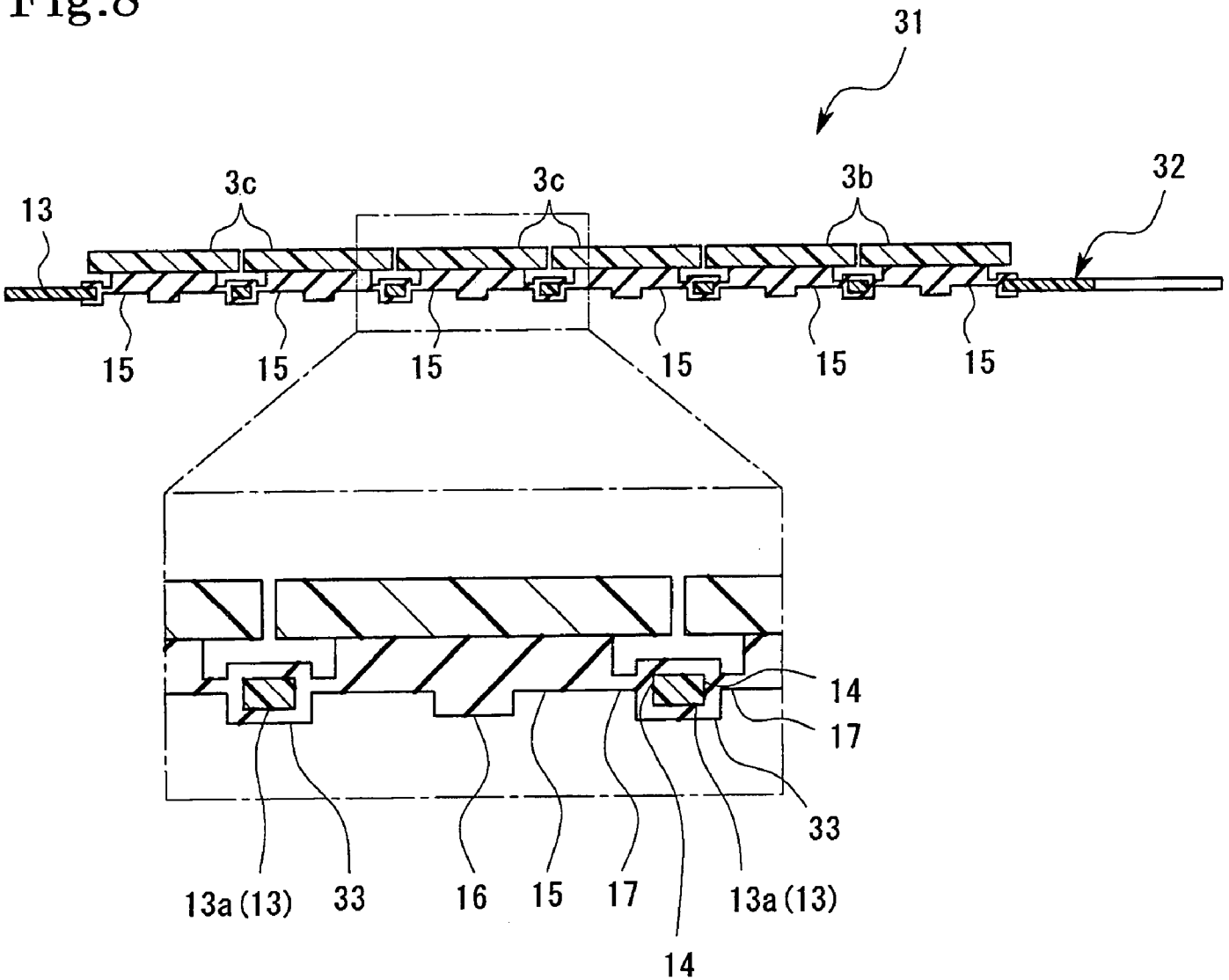
FIG. 8 is a sectional view taken along the line 8—8 of FIG. 7.

Third Embodiment (FIG. 7 and FIG. 8)

In a base sheet 32 of a key sheet 31 of this embodiment, a reinforcing layer 33 made of a thermoplastic elastomer integrally molded with bases 15 is formed as a "reinforcing member" on both sides of each of bridges 13*a* of a hard resin plate 13. Each of the bridges 13*a* serves as a reinforcing member that keeps the adjacent through holes 14 apart from each other. FIG. 7 and FIG. 8 each illustrate the configuration of the key sheet 31 of the third embodiment. FIG. 7 is an external view of the bottom surface of the key sheet 31 according to the third embodiment, and FIG. 8 is a sectional view taken along the line 8—8 of FIG. 7. The reinforcing layer 33 protects the thin and narrow bridge 13*a* from breakage and tear and enhances the rigidity of the bridge 13*a*, so that the distortion of the key sheet 31 can be more consistently prevented by more improving the complete rigidity of the base sheet 32, compared with that of the first embodiment.

The key sheet 31 of the third embodiment can be manufactured from the same materials and by the same method as those of the key sheet 11 described in the first embodiment.

Figure 9:
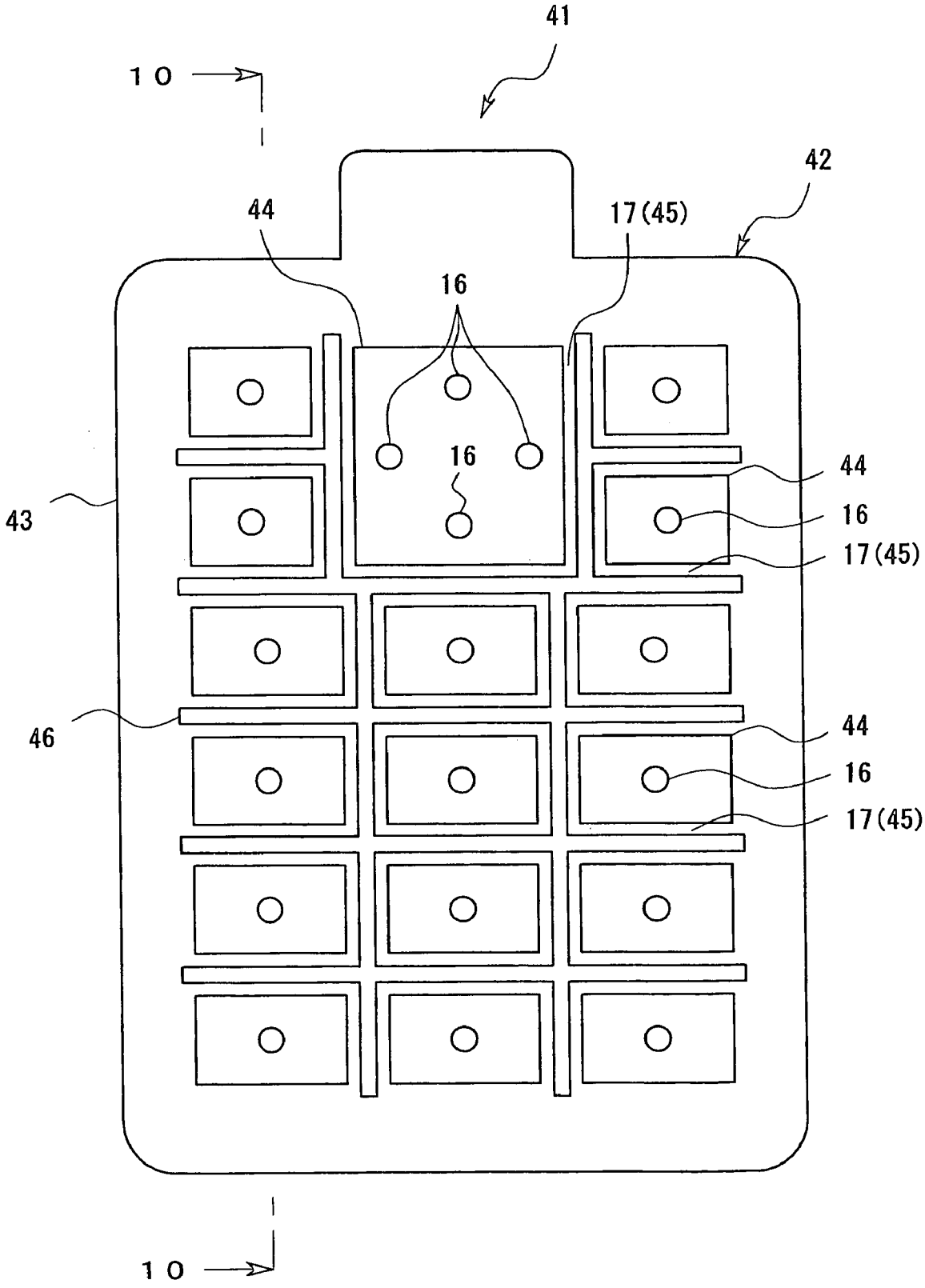
FIG. 9 is an external view of the bottom surface of a key sheet according to a fourth embodiment of the present invention.
Figure 10:
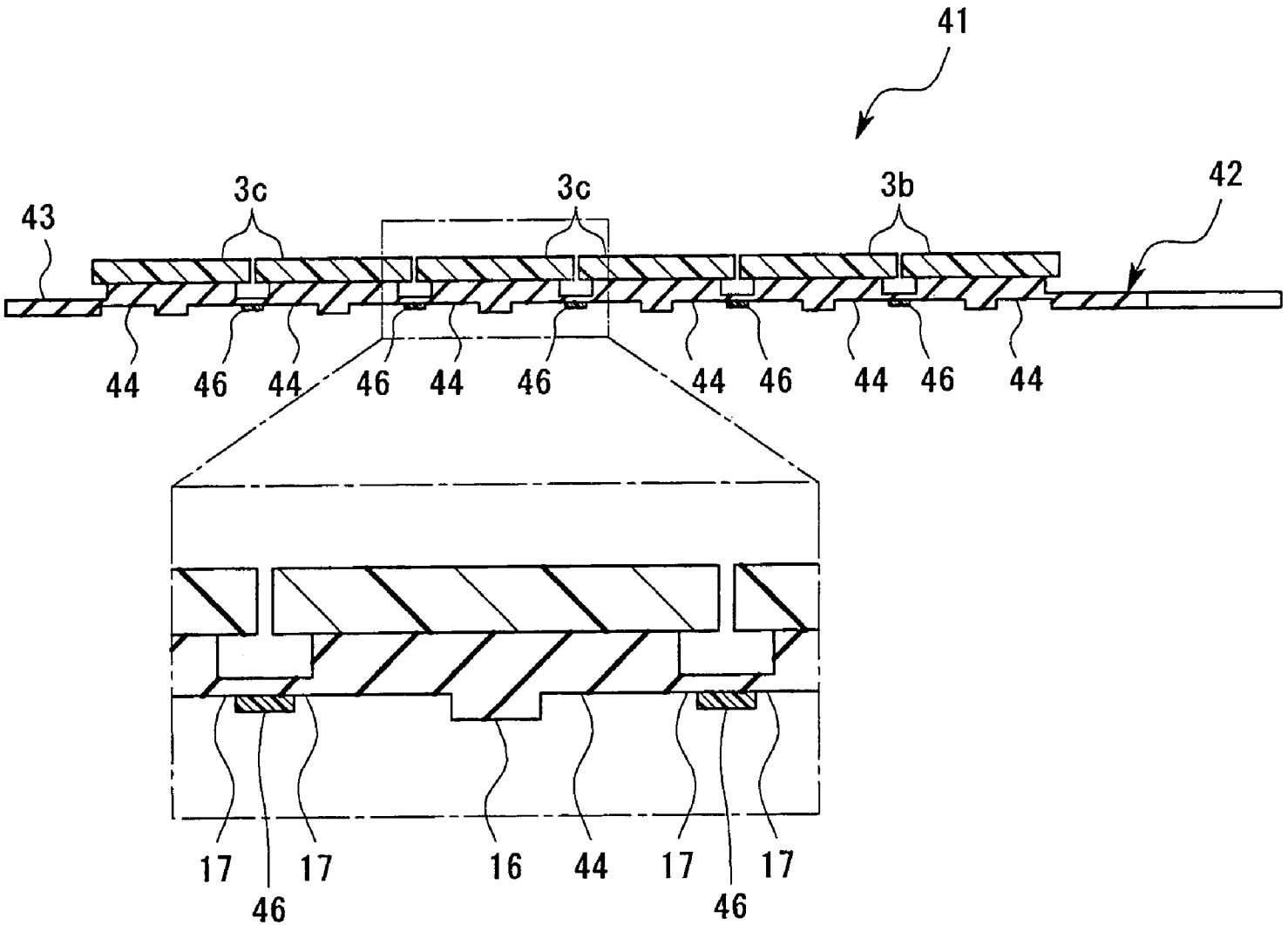
FIG. 10 is a sectional view taken along the line 10—10 of FIG. 9.

Fourth Embodiment (FIG. 9 and FIG. 10)

A key sheet 41 of the this embodiment differs from each of the embodiments described above in that the complete part of a base sheet 42 is formed of an elastic sheet 43 made of a thermoplastic elastomer to serve as a rubber-like elastic body.

FIG. 9 and FIG. 10 each illustrate the configuration of the key sheet 41 of the fourth embodiment. FIG. 9 is an external view of the bottom surface of the key sheet 41 according to the fourth embodiment, and FIG. 10 is a sectional view taken along the line 10—10 of FIG. 9. The key sheet 41 has a reinforcing inner frame 46 constructed of a thin-plate like hard resin molded product. The reinforcing inner frame 46 serves as a "reinforcing member" fixed on the back side of the flexible portion 17 that separates the bases 44 formed on the elastic sheet 43 from each other. In this embodiment, therefore, the reinforcing inner frame 46 increases the rigidity of the flexible portion 17, so that the complete rigidity of the base sheet 42 can be increased and the distortion of the key sheet 41 can be prevented.

For the production of such a base sheet 42, the reinforcing inner frame 46 is manufactured by die-molding such as injection molding. Then, the reinforcing inner frame 46 is transferred into the cavity of a die for injection-molding the thermoplastic elastomer and then the bases 44 are injection-molded to obtain the base sheet 42. The base sheet 42 may be manufactured by coinjection-molding in stead of the above method. After that, predetermined key tops 3 are fixed on the respective bases 44 with an adhesive to obtain the key sheet 41 of this embodiment. The same materials as those used for the key sheet 11 of the first embodiment can be also used in the production of the base sheet 42.

Figure 11:
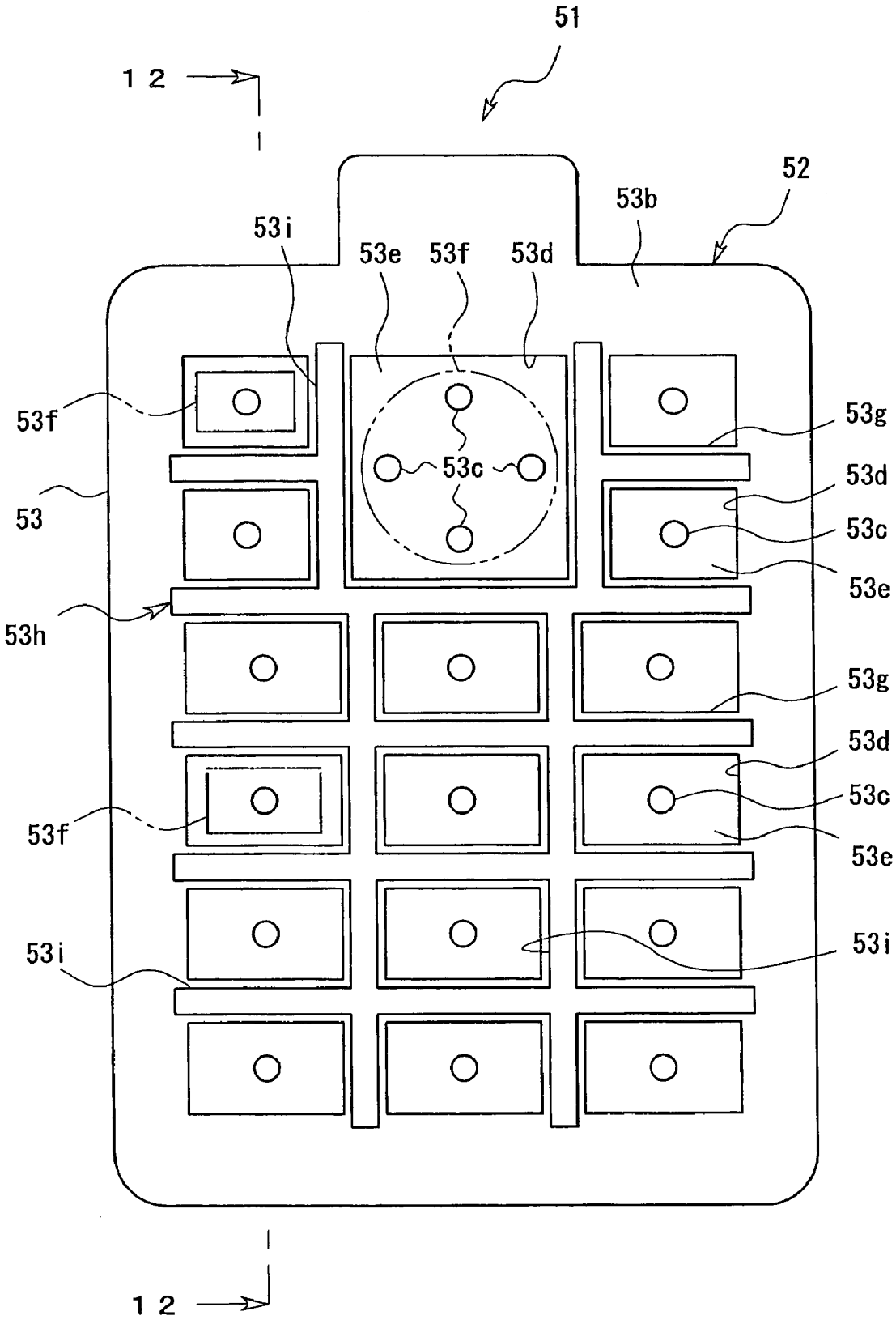
FIG. 11 is an external view of the bottom surface of a key sheet according to a fifth embodiment of the present invention.
Figure 12:
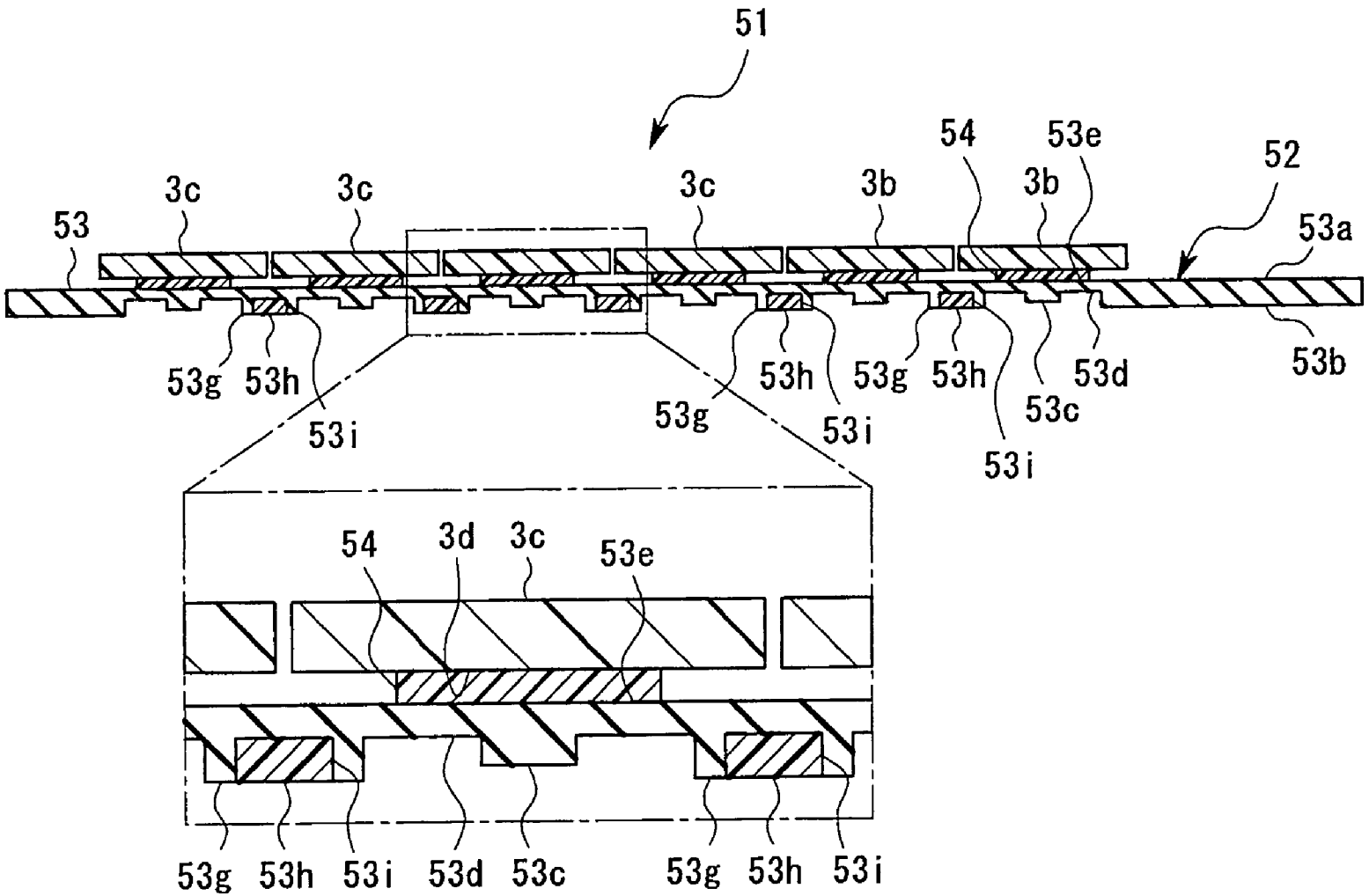
FIG. 12 is a sectional view taken along the line 12—12 of FIG. 11.

Fifth Embodiment (FIG. 11 and FIG. 12)

A key sheet 51 of this embodiment is a modification of the fourth embodiment. FIG. 11 and FIG. 12 each illustrate the configuration of the key sheet 51 of the fifth embodiment. FIG. 11 is an external view of the bottom surface of the key sheet 51 according to the fifth embodiment, and FIG. 12 is a sectional view taken along the line 12—12 of FIG. 11. In this embodiment, the complete part of a base sheet 52 is constructed of an elastic sheet 53 as a rubber-like elastic body. As shown in FIG. 12, the upper surface 53*a* of the elastic sheet 53 has an uncurved flat surface to attain weight reduction of the sheet and thinning of the sheet by thinning the fixed portion of the key top 3. In addition, a plurality of recessed portions 53*d* are formed on the bottom surface 53*b* of the elastic sheet 53 and a plurality of pushers 53*c* are protruded from the recessed portions 53*d*. The portion of the rubber-like elastic body, where the recessed portion 53*d* is formed, is thin and then this thinning portion serves as a base 53*e* for supporting each key top 3 while allowing the key top 3 to be displaced by pushing.

Each key top 3 is fixed on the thin base 53*e* such that the bottom surface 3*d* of the key top 3 floats away from the upper surface 53*a* of the elastic sheet 53 with an adhesive part 54 having a predetermined height. The adhesive part 54 is not applied on the whole surface of the thin base 53*e* but applied on part of the surface thereof and cured. A cured area 53*f* (see, FIG. 11) of the adhesive part 54 is defined in an area smaller than the thin base 53*e* to elastically deform the base 53*e* at the outer area of the cured area 53*f* to thereby displace the key top 3 by pushing. Therefore, like the bases 15, 44 of the embodiments described above, there is no need to form a protruded portion for fixing the key top 3 thereon on the upper surface 53*a* of the elastic sheet 53. The thinning and weight reduction of the elastic sheet 53 can be attained by the same degree as that of the unnecessary protruded portion. Consequently, the key sheet 51 can be thinned.

The thick part 53*g* is formed on the outsides of the recessed portion 53*d* and the base 53*e* such that it surrounds them. The thick part 53*g* has a larger thickness than that of the base 53*e* and retains both the pusher 53*c* and the base 53*e* in a floating manner. In addition, a reinforcing inner frame 53*h*, which is a thin cured resin molded product, is formed as a "reinforcing member" on the thick part 53*g*. As shown in FIG. 11, the reinforcing inner frame 53*h* of this embodiment is formed like a frame having an opening 53*i* such that it keeps out of the recessed portion 53*d* and the base 53*c*.

One of the methods of manufacturing the base sheet 52 as described above is integral molding with die-molding. In this case, the prepared reinforcing inner frame 53*h* is transferred into the cavity of a die for molding the elastic sheet 53 in advance. Then, a rubber-like elastic body, that is, a thermosetting elastomer or a thermoplastic elastomer, is molded to obtain the base sheet 52 as a molded product in which the reinforcing inner frame 53*h* is molded while it is in a state of being embodied in the rubber-like elastic body. After that, the base sheet 52 is removed from the molding die and then key tops 3 are fixed on the base sheet 52 with an adhesive (the adhesive part 54), resulting in the key sheet 51. This process allows the elastic sheet 53 to be firmly fixed on the reinforcing inner frame 53*h*. Thus, there is no removal of the reinforcing inner frame 53*h* as far as there is no breakage of the rubber-like elastic body. The resulting base sheet 52 shows excellent integrity. In addition, the base sheet 52 can be manufactured using the same materials as those used for the key sheet 11 of the first embodiment.

Furthermore, in another method of manufacturing the base sheet 52, the rubber-like elastic body is die-molded such that a portion for embedding the reinforcing inner frame 53*h* in the thick part 53*g* shown in FIG. 12 is shaped into a groove for mounting the reinforcing inner frame 53*h*. Such a groove is shaped like a hollow opened downwardly. After the removal of the mounting groove from the molding die, the reinforcing inner frame 53*h* independently prepared is fixed in the mounting groove with an adhesive (not shown) to obtain the base sheet 52 having the reinforcing inner frame 53*h* being embedded. Subsequently, the key sheet 51 can be obtained by fixing the key tops 3 on the base sheet 52 with the adhesive (the adhesive part 54). According to the process, the reinforcing inner frame 53*h* is not used in the step of die-molding the rubber-like elastic body. Therefore, any material having other excellent characteristics such as rigidity, durability, and transparency required for the key sheet 51 can be used even though the material has a low thermal resistance, is easily deformed by heat, and does not adapt itself to die-molding as far as the characteristics of the reinforcing inner frame 53*h* are concerned.

Figure 13:
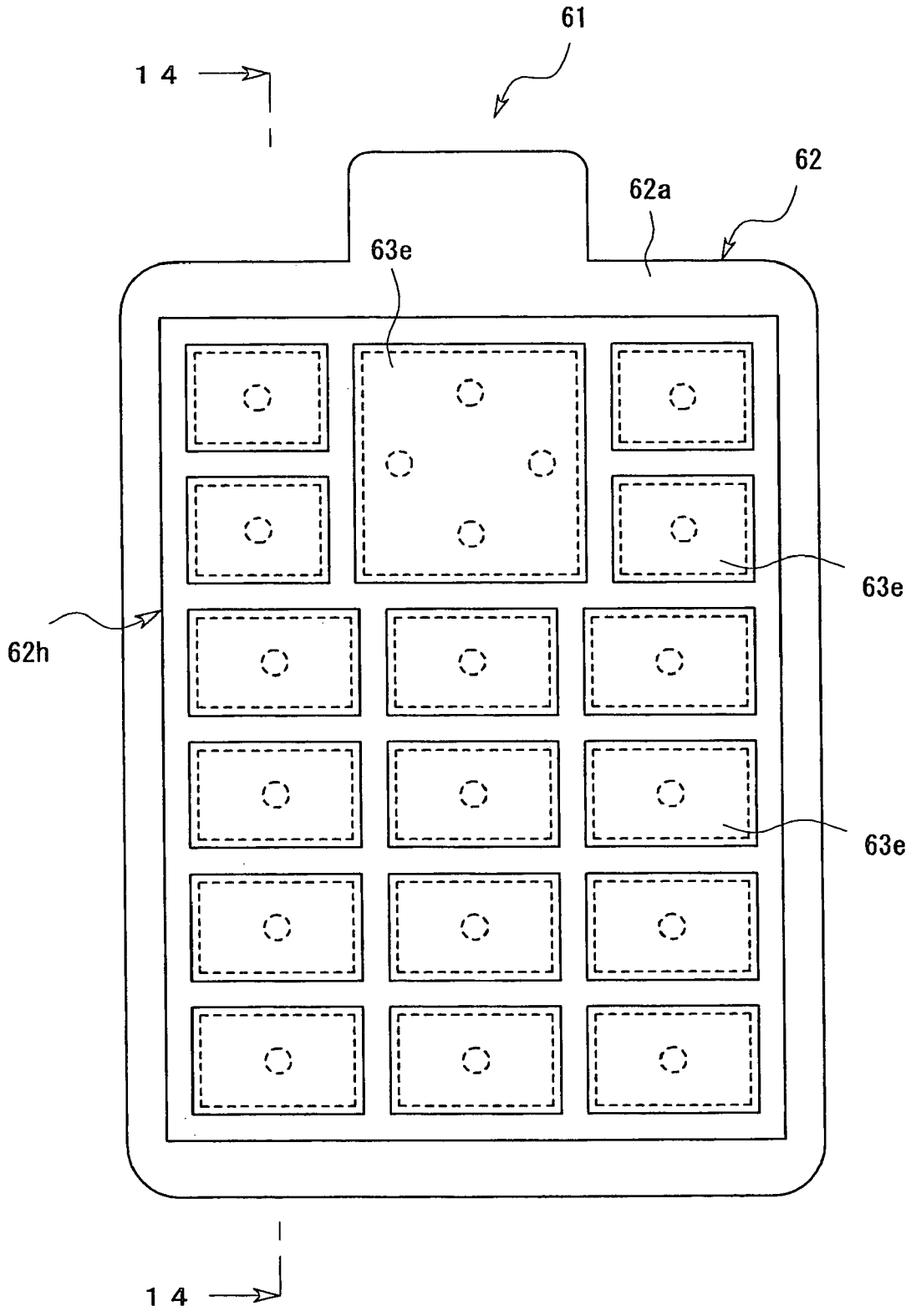
FIG. 13 is an external view of the upper surface of a key sheet according to a sixth embodiment of the present invention.
Figure 14:
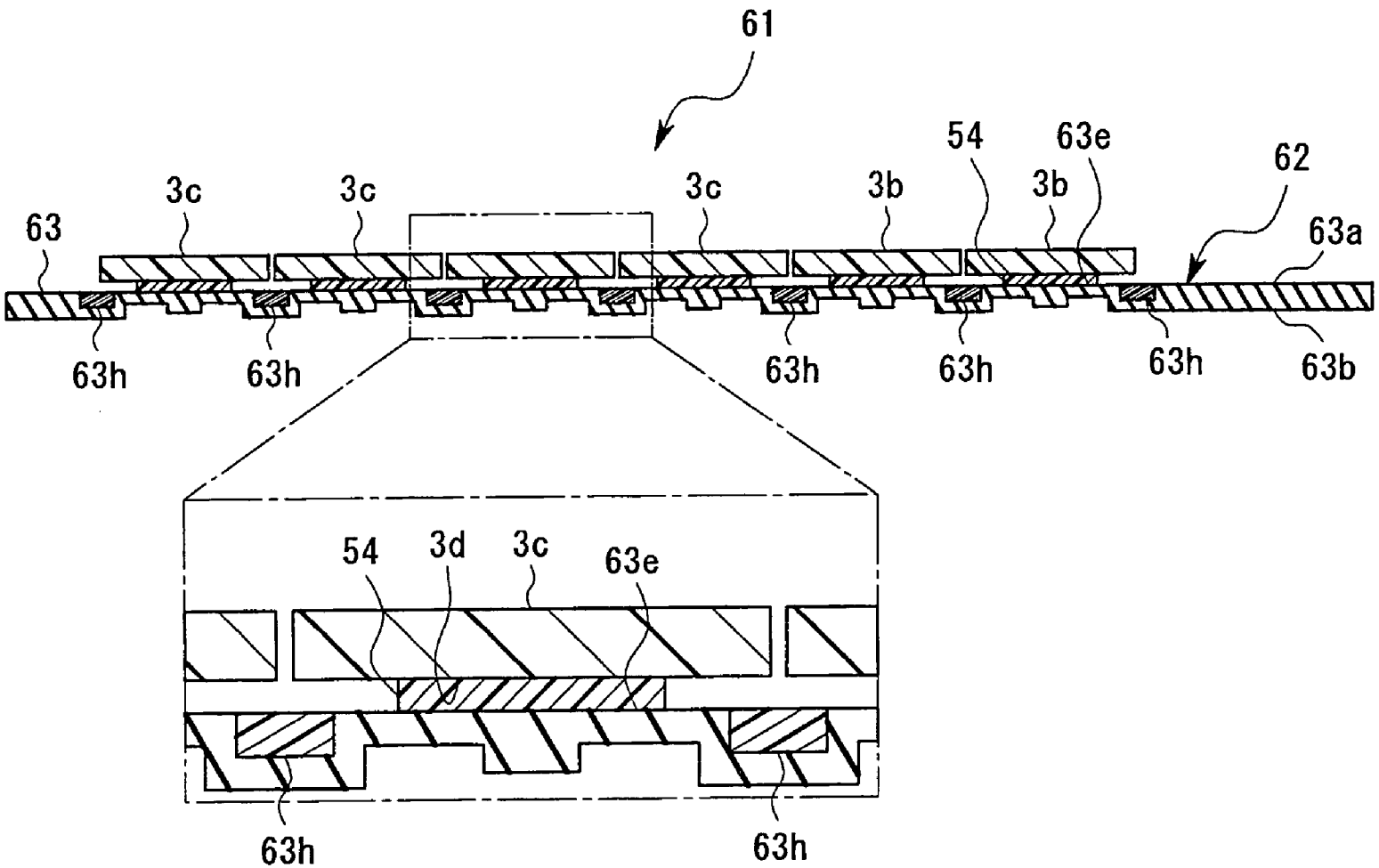
FIG. 14 is a sectional view taken along the line 14—14 of FIG. 13.

Sixth Embodiment (FIG. 13 and FIG. 14)

A key sheet 61 of the sixth embodiment is a modification of the fifth embodiment and the configuration thereof is illustrated in each of FIG. 13 and FIG. 14. FIG. 13 is an external view of the upper surface of the key sheet 61 according to the sixth embodiment, and FIG. 14 is a sectional view taken along the line 14—14 of FIG. 13. The key sheet 61 differs from that of the fifth embodiment in that a reinforcing frame 63*h* is formed as a "reinforcing member" so as to surround bases 63*e* located in the outer edge portion of a base sheet 62 as shown in FIG. 13. Thus, the reinforcing effect can be also obtained for the outer edge portion of the base sheet 62, allowing a further improvement in rigidity in full scale.

Furthermore, in the key sheet 61 of this embodiment, as shown in FIG. 14, the reinforcing frame 61*h* is exposed from the upper surface 63*a* of the elastic sheet 63 to serve as a base sheet 62. This allows, for example, the use of a transparent material for key tops 3, and the color of the reinforcing frame 63*h* can be considered to be a part of the design of the base sheet 62. Thus, the key sheet 61, from which the unprecedented design effect can be visually identified, can be obtained. Moreover, the key sheet 61 may be of an illuminating-type type. Specifically, an illuminating cut-out alphabet is printed on the key top 3 and the base sheet 62 is provided with translucency. Furthermore, the reinforcing frame 63*h* may be colored with a light blocking effect. In this case, light leak through the reinforcing frame 63*h* can be prevented because the reinforcing frame 63*h* comes close to the space between the adjacent key tops 3.

The key sheet 61 of the sixth embodiment can be manufactured from the same materials and by the same method as those of the key sheet 51 described in the fifth embodiment.

Figure 15:
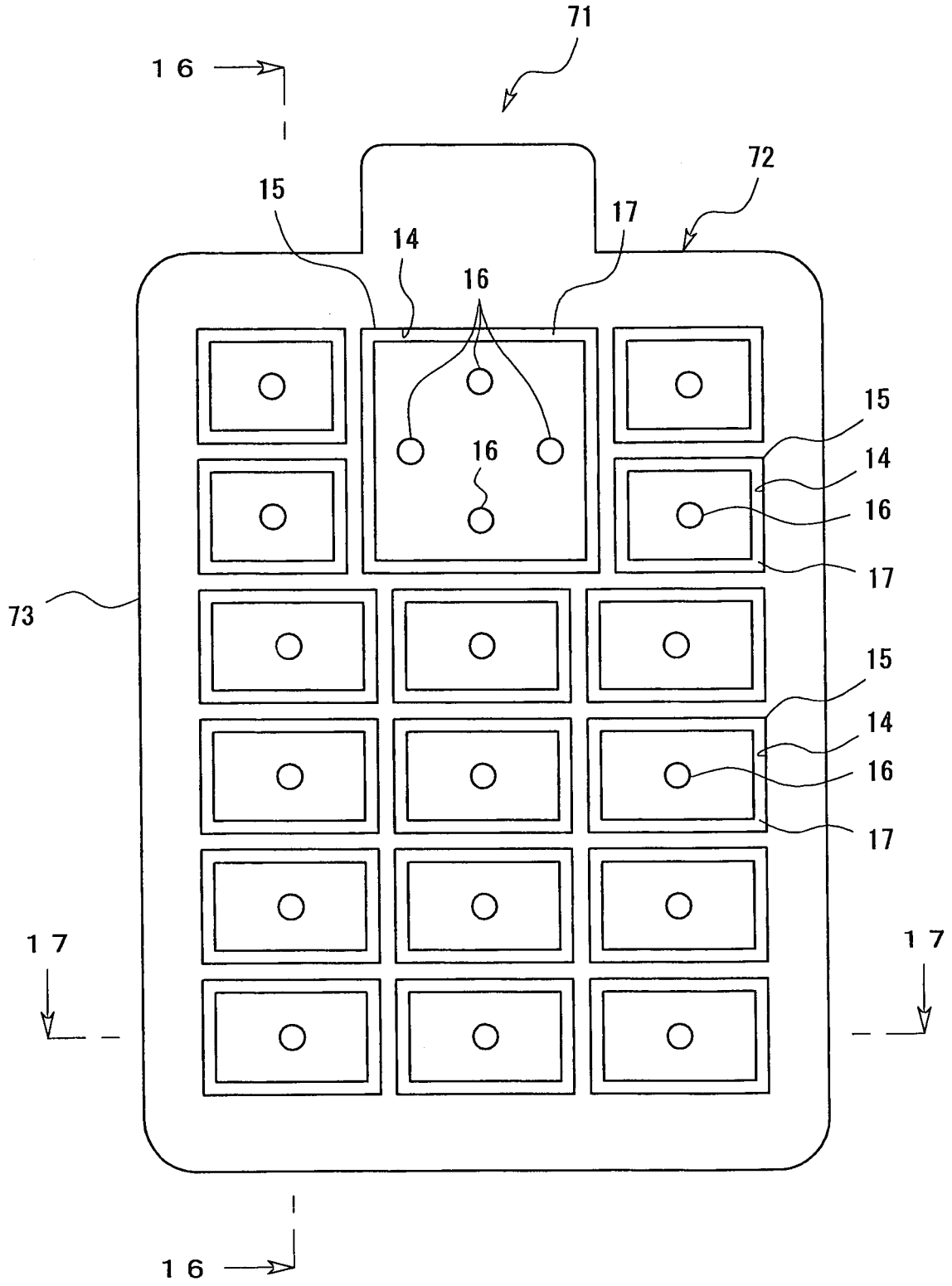
FIG. 15 is an external view of the back surface of a key sheet according to a seventh embodiment.
Figure 16:
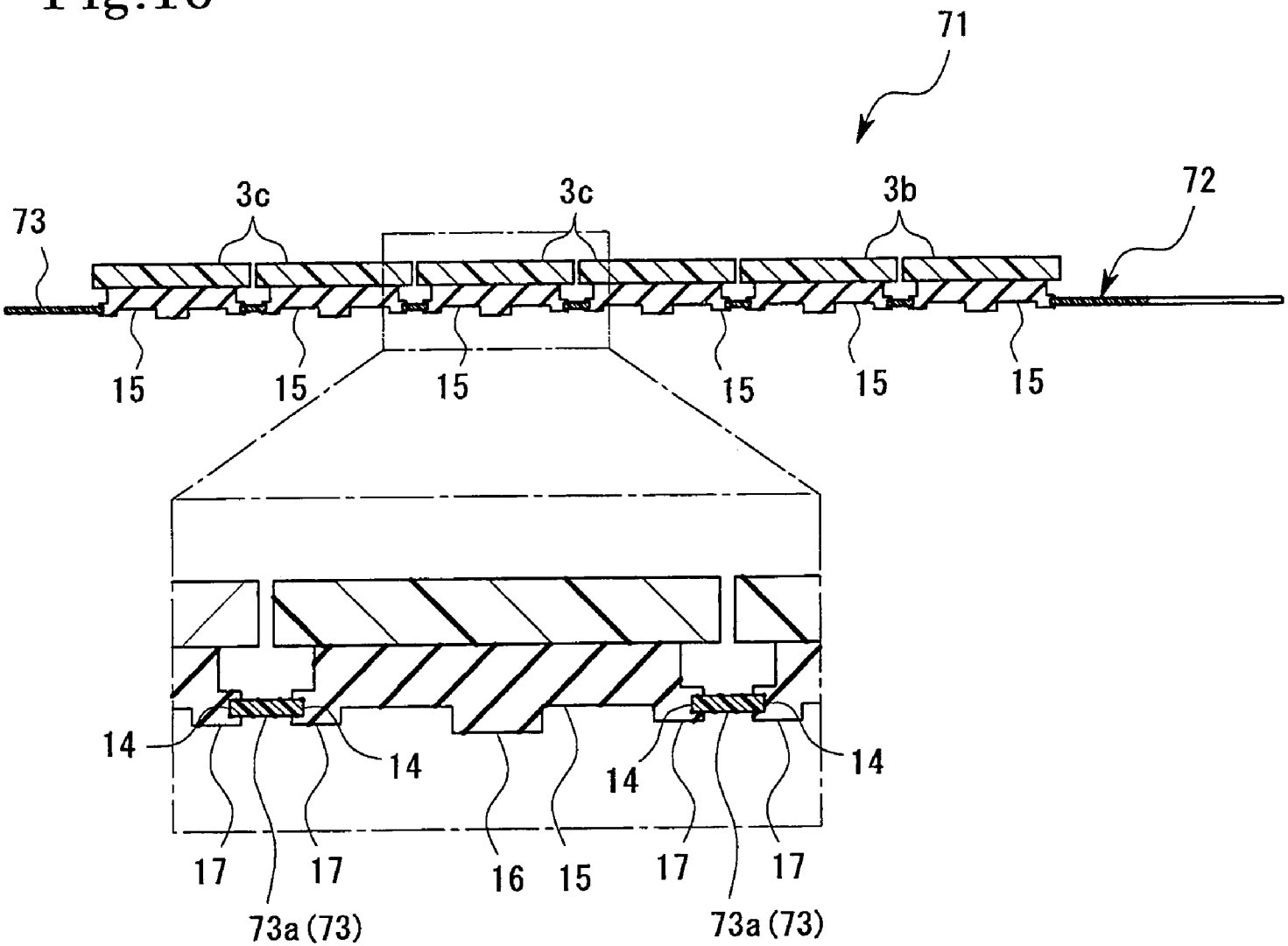
FIG. 16 is a sectional view taken along the line 16—16 of FIG. 15.
Figure 17:
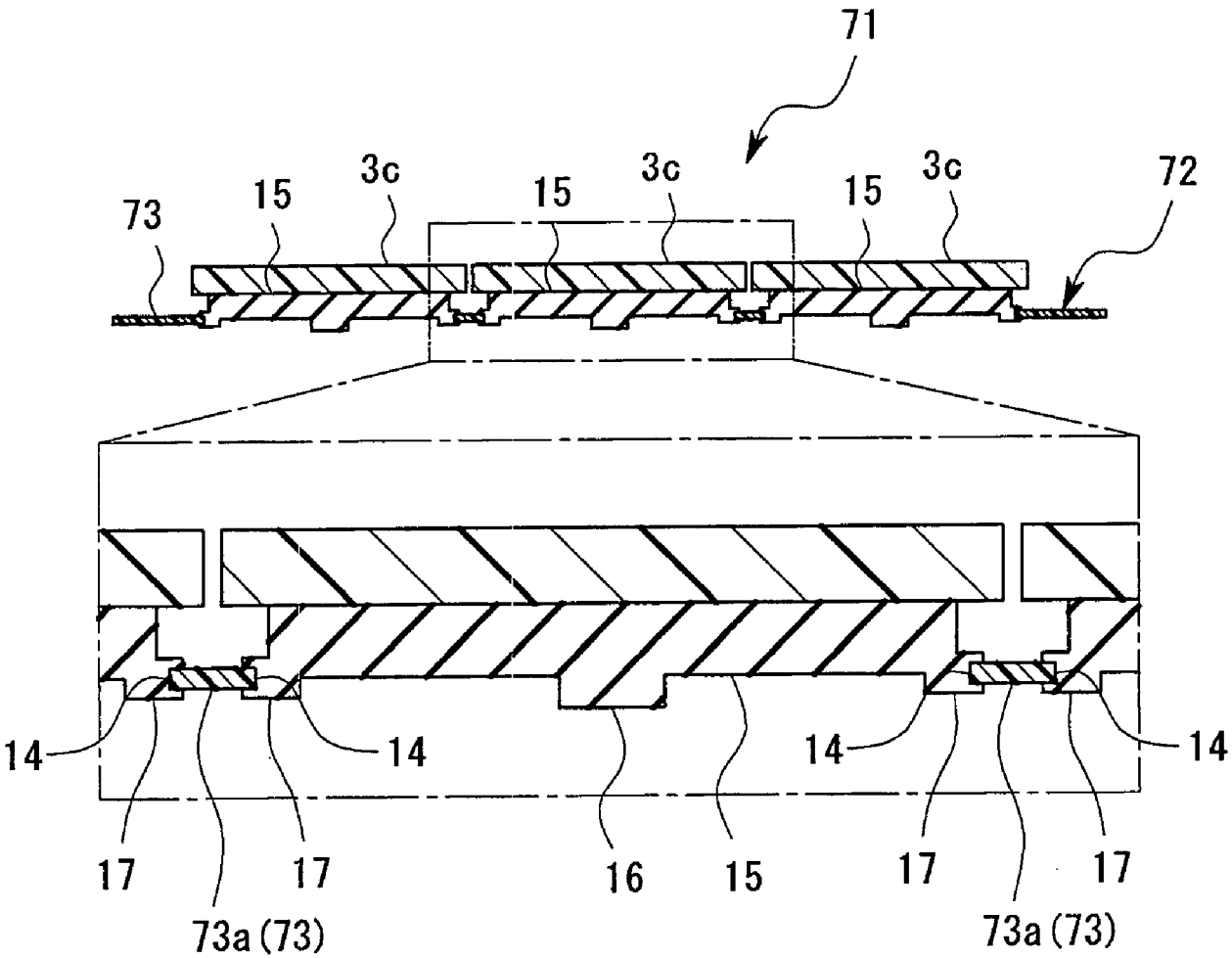
FIG. 17 is a sectional view taken along the line 17—17 of FIG. 15.

Seventh Embodiment (FIG. 15 to FIG. 17)

A key sheet 71 of this embodiment is constructed of a base sheet 72 and key tops 3 fixed on the base sheet 72. The key sheet of the seventh embodiment is illustrated in FIGS. 15 to 17. FIG. 15 is an external view of the bottom surface of the key sheet 71 according to the seventh embodiment. FIG. 16 is a sectional view taken along the line 16—16 of FIG. 15. FIG. 17 is a sectional view taken along the line 16—16 of FIG. 15. The key sheet 71 of this embodiment differs from the key sheet 11 of the first embodiment to a large extent in that the thin-plate like hard resin is used as a "reinforcing member" in the key sheet 11 while a resin film is used as a "reinforcing member" in the key sheet 71.

The base sheet 72 is provided with a sheet of a resin film 73 as a substrate. The resin film 73 is of a rectangular shape having rounded corners and a rectangular tongue portion on the upper side thereof. The resin film 73 has bridges 73*a* remaining in the form of a lattice to provide rectangular through holes 14 corresponding to the portions where the respective key tops 3 are formed. Each through hole 14 is closed by a base 15 made of a thermoplastic elastomer to serve as a rubber-like elastic body. As shown in each of the enlarged cross sections of FIGS. 16 and 17, the base 15 has the corresponding key top 3 fixed on the upper surface thereof with an adhesive (not shown) and a downwardly-extended cylindrical pusher 16 on the bottom surface thereof. Formed on the outer edge of the base 15 is a flexible portion 17 to be displaced by pushing. The flexible portion 17 supports the key top 3 in a floating condition to allow the key top 3 to be displaced by pushing the key top 3 downward in the figure. The complete rigidity of the base sheet 72 can be improved by configuring the through hole 14 to be filled with the base 15. As a result, the distortion of the key sheet 71 can be entirely prevented even though the weights of the key tops 3 are loaded with the key sheet 71 turned upright or turned upside down. Accordingly, the configuration of the key sheet 71 of this embodiment prevents the generation of problems such as poor operation due to the displacement between the pusher 16 and the contact switch 1*e* of the circuit board 1*d*, a bad feel in manipulation due to a substantial difference between the stroke lengths of the respective key tops 3 when pushed, and a loss of the design performance of the mobile phone 1.

Here, the material of each part that constitutes the base sheet 72 will be described. At first, used for the resin film 73 of this embodiment is a hard material having rigidity enough to prevent the overall distortion of the key sheet 71 even though the key sheet 71 is turned upright or turned upside down in a state where a plurality of key tops 3 supported by the respective bases 15 are exposed through the operation opening 1*b* formed in the case 1*a* of the mobile phone 1 with no partition bridge. Examples of an available material include polycarbonate, polyethylene terephthalate, nylon, vinyl chloride, polyamide, polyimide, and alloy films belonging to these materials. Concrete examples of such a resin film 73 include lupiron (trademark) film (Mitsubishi Engineering-Plastics Corp.) and Panlite (trademark) sheet (Teijin Ltd.).

In addition, examples of the thermoplastic elastomer that constitutes the base 15 include a styrene elastomer, an ester elastomer, a urethane elastomer, an olefin elastomer, an amide elastomer, a butadiene elastomer, an ethylene-vinyl acetate elastomer, a vinyl chloride elastomer, a fluorocarbon rubber elastomer, an isoprene elastomer, and a polyethylene chloride elastomer. The hardness of the elastomer is defined by JIS K6253 and is preferably in the range of Types A40 to 80. A hardness of less than Type A40 leads to a disadvantage in that the base 15 is excessively softened to cause poor feel of pushing a switch at the time of input. On the other hand, a hardness in excess of Type A80 leads to a disadvantage in that the flexible portion 17 is hardly deformed so that the pushing load for the input of a switch increases.

For manufacturing the base sheet 72 as described above, through holes 14 are formed in a resin film 73 by means of a cutting die or the like and the resin film 73 is then transferred to a die for injection molding. Subsequently, a thermoplastic elastomer is injected into the cavity of the die where the bases 15 can be molded. After the integral molding of the bases 15 with the respective through holes 14, a base sheet 72 can be obtained. Subsequently, the predetermined key tops 3 adhere on the respective bases 15, resulting in the key sheet 71 of this embodiment.

Figure 18:
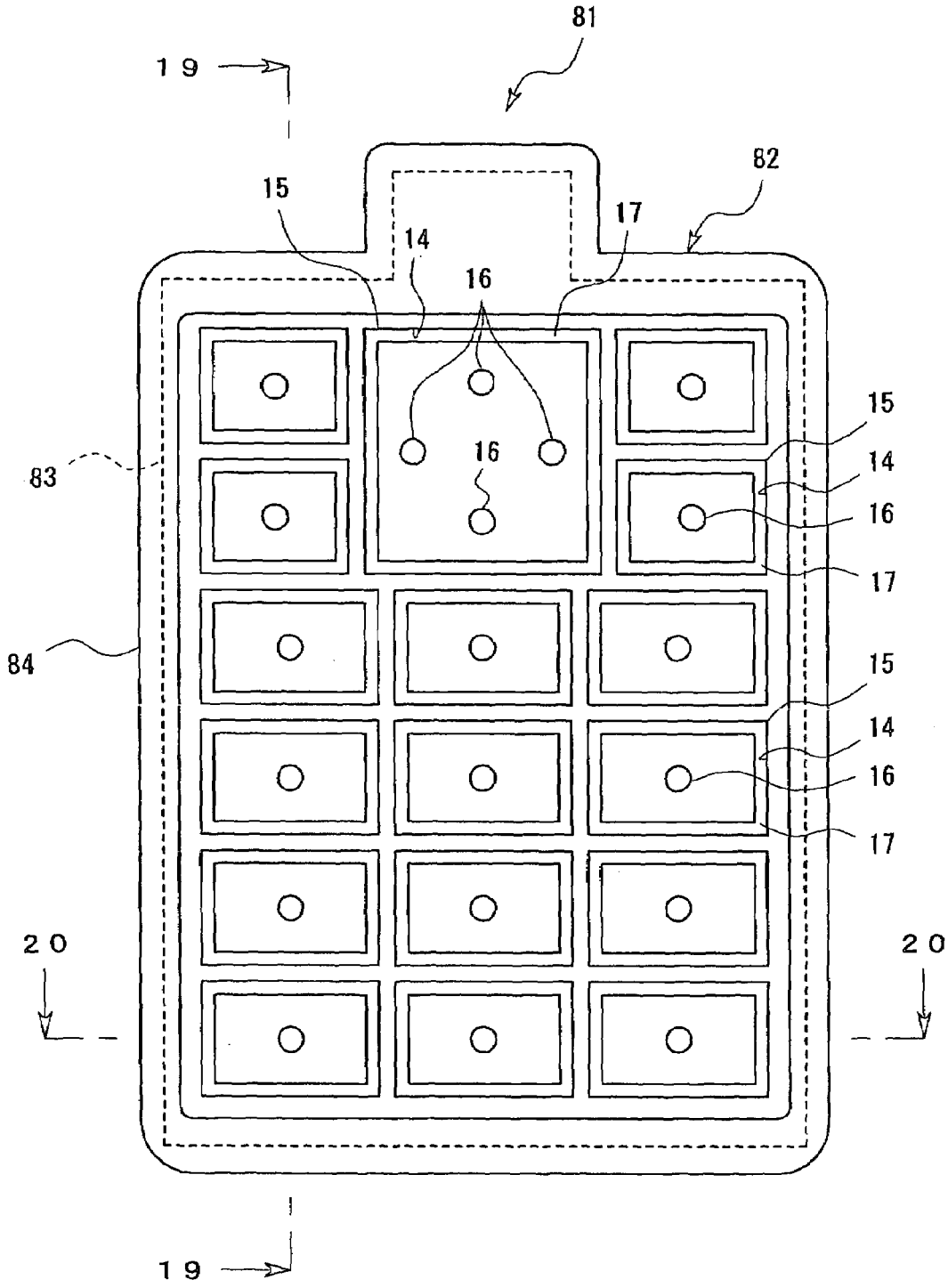
FIG. 18 is an external view of the back surface of a key sheet according to an eighth embodiment of the present invention.
Figure 19:
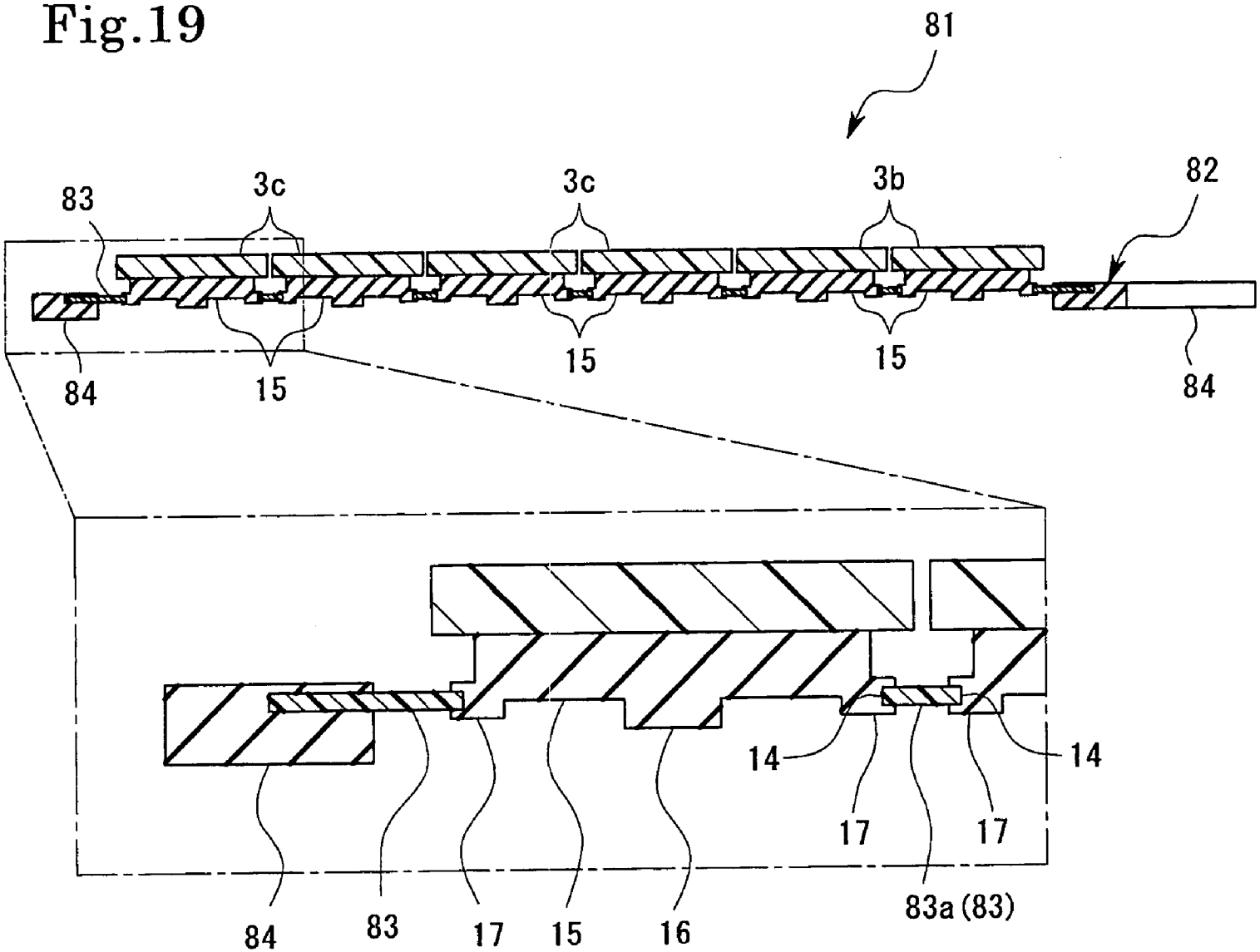
FIG. 19 is a sectional view taken along the line 19—19 of FIG. 18.
Figure 20:
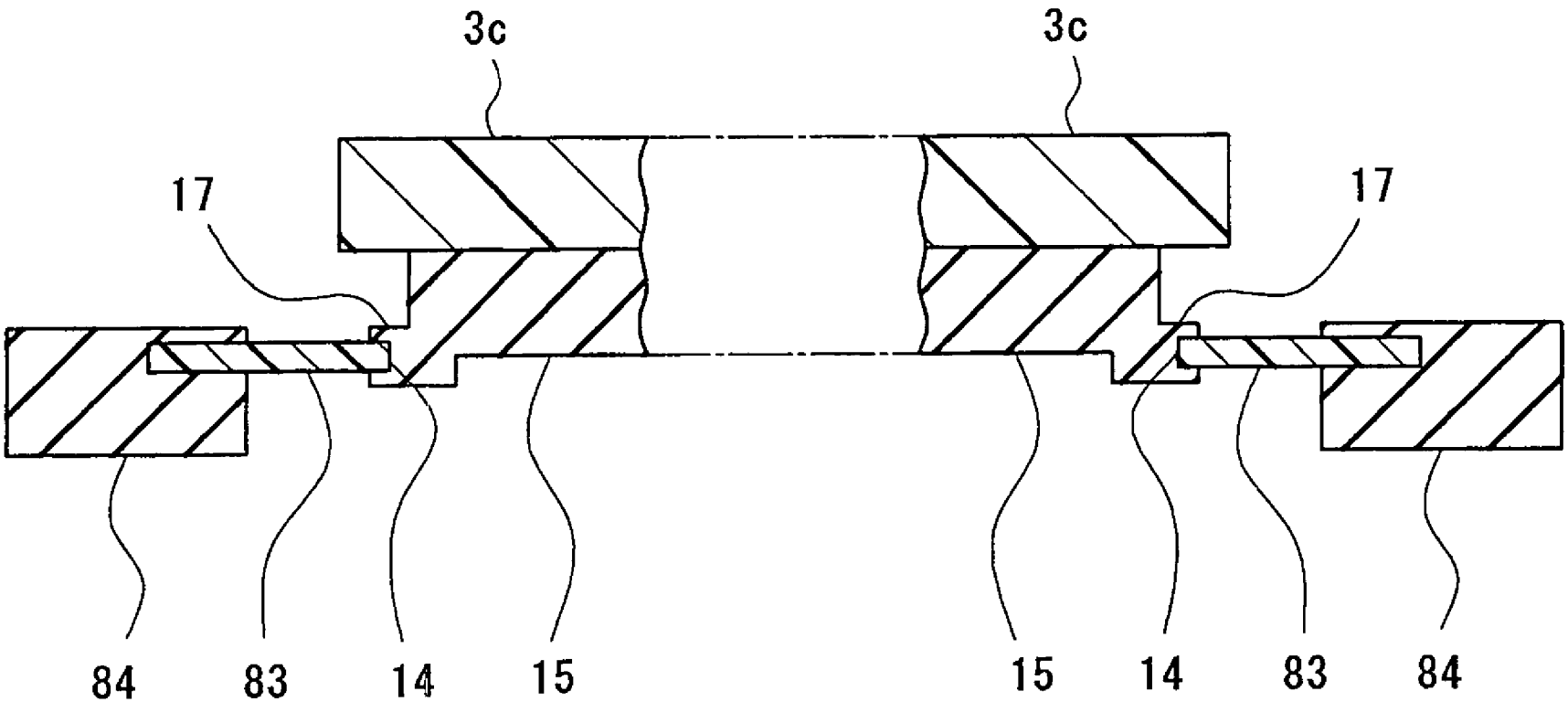
FIG. 20 is an enlarged sectional view taken along the line 20—20 of FIG. 18.

Eighth Embodiment (FIGS. 18 to 20)

A key sheet 81 of this embodiment differs from that of the seventh embodiment in that a reinforcing outer frame 84 made of a thermoplastic elastomer is integrally molded on a resin film 83 of a base sheet 82. FIGS. 18 to 20 each illustrate the configuration of the key sheet 81 of the eighth embodiment. FIG. 18 is an external view of the bottom surface of the key sheet 81 according to the eighth embodiment, FIG. 19 is a sectional view taken along the line 19—19 of FIG. 18, and FIG. 20 is a sectional view taken along the line 20—20 of FIG. 18. The overall rigidity of the base sheet 81 is further improved, compared with the seventh embodiment, by forming the reinforcing outer frame 84 that covers the outer edge of the resin film 83. In addition, the reinforcing outer frame 84 made of the thermoplastic elastomer is excellent in fitting to the surface to be brought into pressure contact therewith when the frame 84 is retained by pressure contact with the portion around the edge of an operation opening 1*b* formed in the back side 1*c* of the case 1*a* of the mobile phone 1 and a circuit board 1*d* installed in the case 1*a*. Therefore, while strong holding power is exerted, the outstanding sealing performance to the liquid and dust which tend to enter the inside of the case 1*a* from the operation opening 1*b* can be also attained. The key sheet 81 can be also manufactured by the same way as that of the key sheet 71 of the seventh embodiment. In addition, the same materials as those used for the key sheet 71 can be also used.

Figure 21:
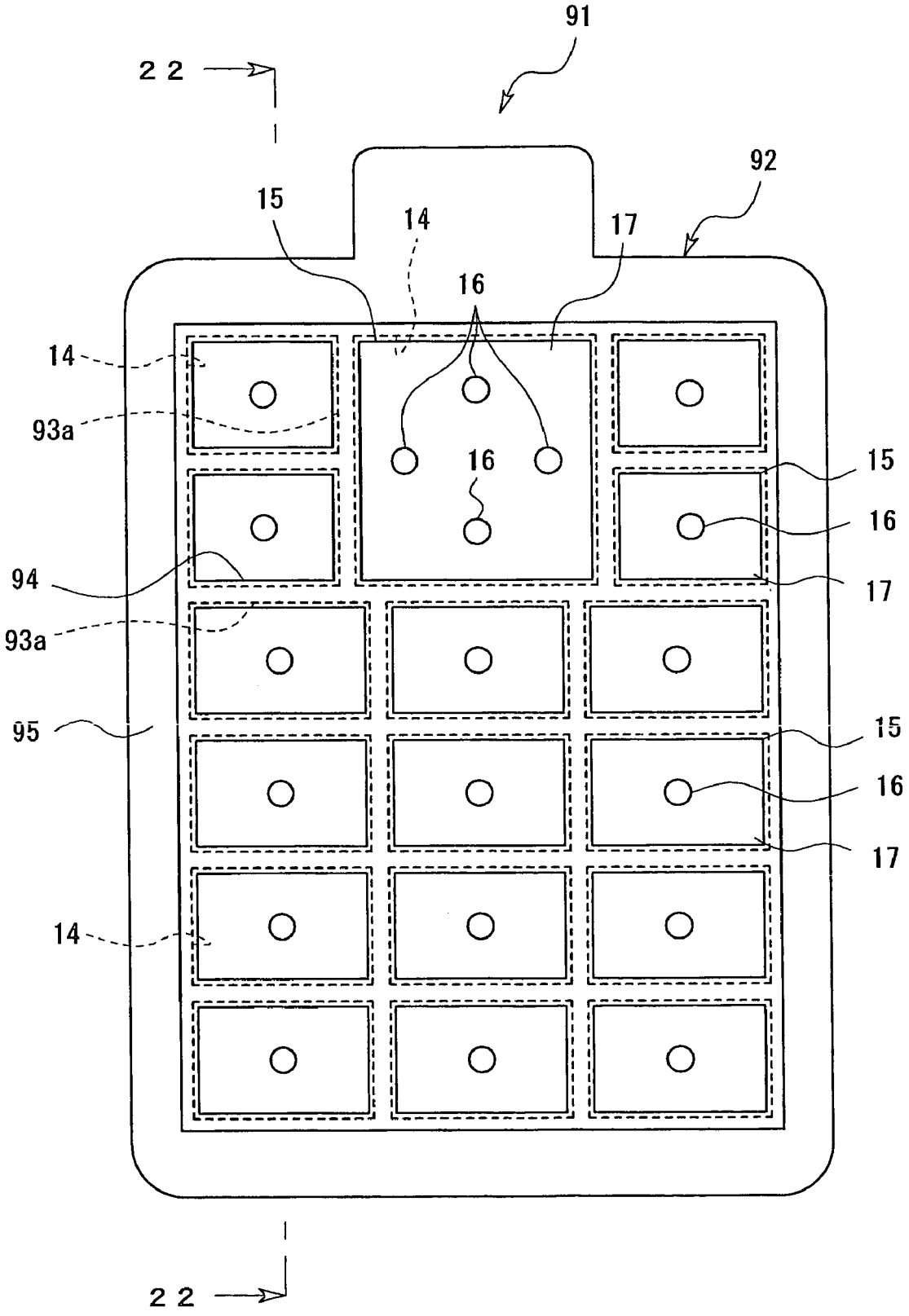
FIG. 21 is an external view of the back surface of a key sheet according to a ninth embodiment of the present invention.
Figure 22:
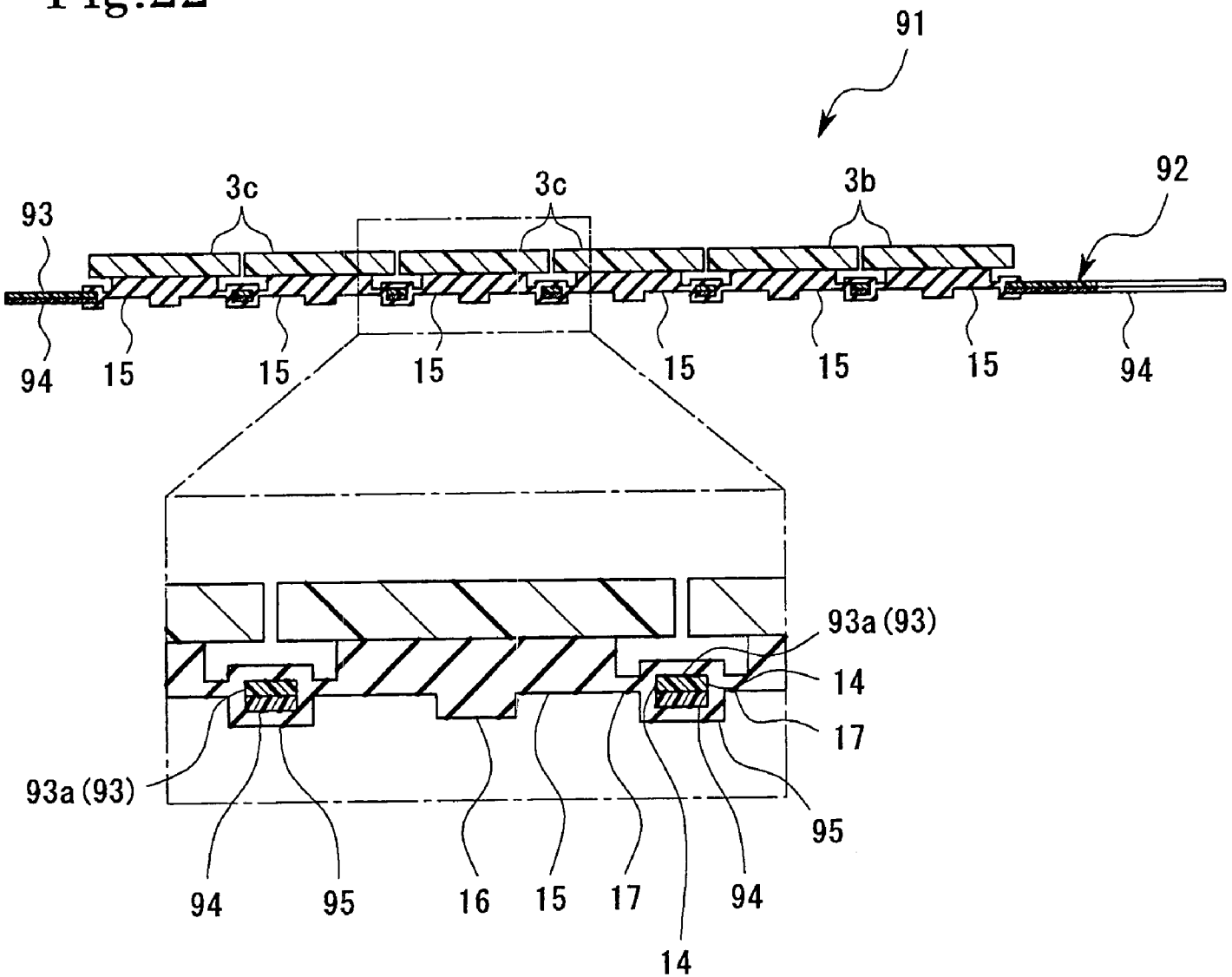
FIG. 22 is a sectional view taken along the line 22—22 of FIG. 21.

Ninth Embodiment (FIG. 21 and FIG. 22)

A key sheet 91 of this embodiment is prepared such that a reinforcing layer 94 to serve as a cured product is formed as a "reinforcing member" by applying a liquefied resin on the complete back surface of a resin film 93 that constitutes a base sheet 92. In addition, a reinforcing layer 95 made of a thermoplastic elastomer integrally molded with bases 15 is further formed as a "reinforcing member" on both sides of bridges 93*a* of the resin film 93, each of which separates through holes 14 from each other. FIGS. 21 and 22 each illustrate the configuration of the key sheet 91 of the ninth embodiment. FIG. 21 is an external view of the bottom surface of the key sheet 91 according to the ninth embodiment, FIG. 22 is a sectional view taken along the line 22—22 of FIG. 21. In this embodiment, accordingly, the complete resin film 93 is reinforced by the reinforcing layer 94 and then the thin and narrow bridge 93*a* is further reinforced by the reinforcing layer 95 to improve the overall rigidity of the base sheet 92 to thereby prevent the distortion of the key sheet 91.

A reinforcing layer 94 may be made from a resin selected from: reactive-curing resins such as a thermosetting, photo-curing, humidity-curing, and pressurization and humidification curing resin; and nonreactive-curing resins such as a thermoplastic resin. Furthermore, the hard resins described in the first embodiment may be used. Of those, the reactive-curing resins such as a pressurization and humidification curing resin and a photo-curing resin are particularly preferable because they can be quickly cured at low temperatures to allow an increase in productivity. In addition, the reactive-curing resins are preferable in that the materials of the thermoplastic elastomer and the resin film 93 can be selected from broader options because there is no need of heating and the resin film 93 used may be one having a lower softening point or lower thermal resistance. Furthermore, as the key sheet 91 are reinforced by the reinforcing layers 94, 95, a material to be used for the resin film 93 of this embodiment may be softer and have lower rigidity, compared with each of the embodiments described above. The key sheet 91 can be also manufactured by the same way as that of the key sheet 71 of the seventh embodiment. In addition, the same materials as those of the key sheet 71 can be also used.

Figure 23:
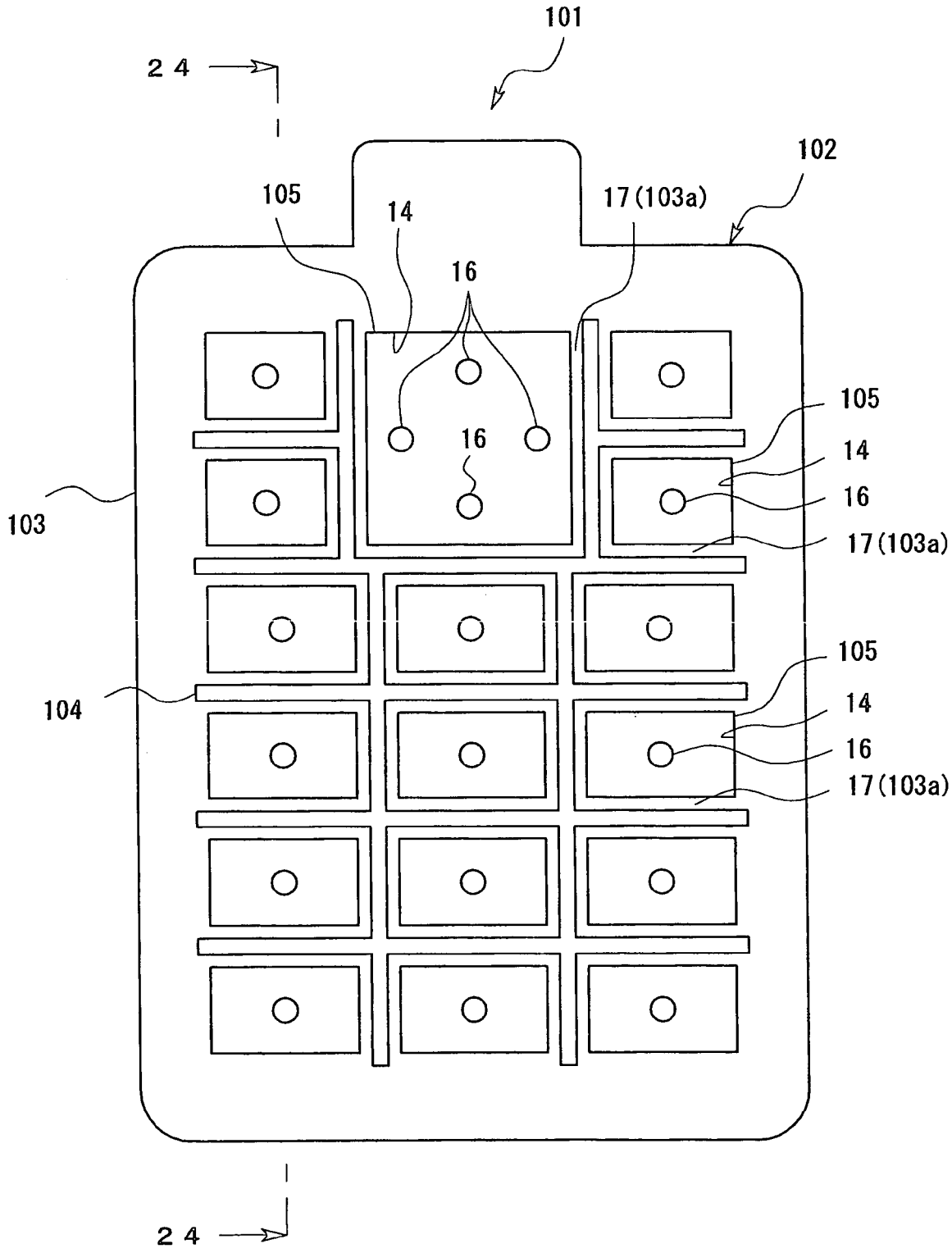
FIG. 23 is an external view of the back surface of a key sheet according to a tenth embodiment of the present invention.
Figure 24:
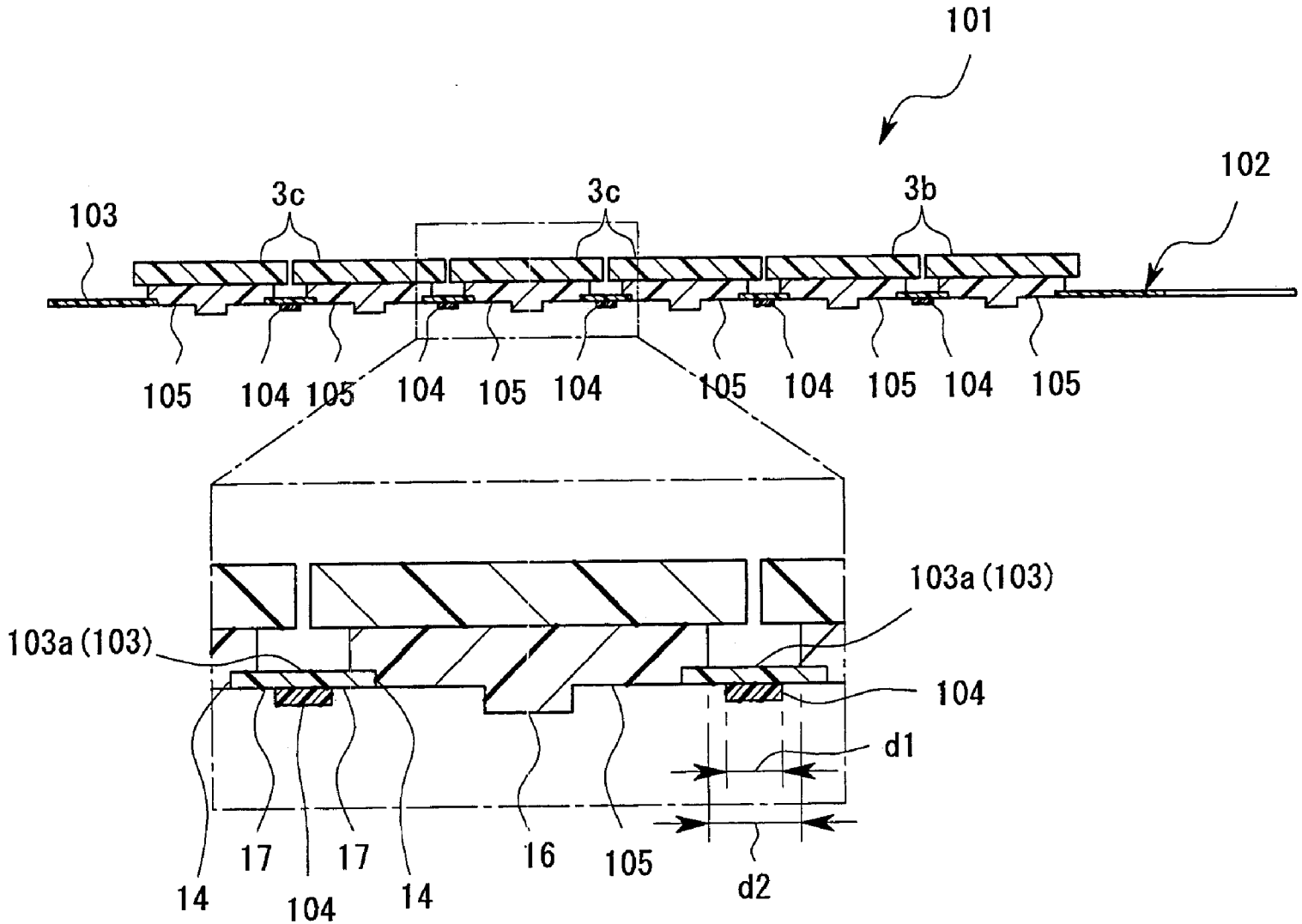
FIG. 24 is a sectional view taken along the line 24—24 of FIG. 23.

Tenth Embodiment (FIG. 23 and FIG. 24)

A key sheet 101 of this embodiment differs from each of the embodiments described above in that the bases 105 of a base sheet 102 are made of a hard resin. FIG. 23 and FIG. 24 each illustrate the configuration of the key sheet 101 of the tenth embodiment. FIG. 23 is an external view of the back surface of the key sheet 101 according to the tenth embodiment, and FIG. 24 is a sectional view taken along the line 24—24 of FIG. 23. Such a base 105 can be integrally formed on a resin film 103 by the same way as that of the seventh embodiment described above, i.e., by injection molding. In addition, in the base sheet 102 of this embodiment, a reinforcing inner frame 104 made of a thin-plate like resin molded product is fixed as a "reinforcing member" by an adhesive on the back surface of each bridge 103*a* of the resin film 103, the bridge 103*a* separating through holes 14 from each other. In this embodiment, therefore, the reinforcing inner frame 104 improves the rigidity of the bridge 103*a*, so that the overall rigidity of the base sheet 102 can be improved and the distortion of the key sheet 101 can be prevented. Furthermore, as shown in FIG. 24, the width d1 of the reinforcing inner frame 104 is smaller than the space d2 between the adjacent bases 105 on the bridge 103*a*, so that a flexible portion 17 that retains the base 105 in a floating condition is formed on the bridge 103*a*. Thus, the bridge 103*a* is partly used as the flexible portion 17 and the bridge 103*a* is reinforced by the reinforcing inner frame 104. As a result, a material to be used for the resin film 103 of this embodiment is softer and has lower rigidity, compared with each of the embodiments described above. In other words, the resin film 103 of the present invention acts as a flexible portion to be displaced by pushing, rather than as a reinforcing member in view of the complete key sheet 101. An example of such a resin film is Diamiron (trademark) C (Mitsubishi Plastics Industries Ltd.). Therefore, the key sheet 101 of this embodiment secures the rigidity enough to prevent complete distortion and a good feel of manipulation can be obtained as the flexible portion 17 is soft.

Modified Examples of Embodiments

Modified Examples of the respective embodiments will be described below.

In each of the embodiments described above, a thermoplastic resin, a thermosetting resin, or a rubber-like elastic body such as silicone rubber or a thermoplastic elastomer can be used as a material of the key top 3. In addition, the base sheets 12, 22, 32, 42, 52, 62, 72, 82, 92, and 102 have high rigidity, so that it is also possible to use one made of a weighty metallic material. In addition, the key tops 3 may have display portions thereon to indicate characters, numbers, symbols, and the like by ink, plating, and the like. In addition, the key tops 3 may be constructed as illuminating-type key tops with cut-out characters or with characters. Furthermore, each of the key tops 3 may have another conformation. Besides, each of the base sheets 12, 22, 32, 42,52, 62, 72, 82, 92, and 102 may have another conformation.

In each of the embodiments described above, each of the bases 15, 44, 53*e*, 63*e*, and 105 is in a rectangular shape in plane. Alternatively, each of the bases may be in a round shape, an elliptical shape, or other polygonal shape. Furthermore, the shape of each base sheet 12, 22, 32, 42, 52, 62, 72, 82, 92, or 102 may be of another shape, irrespective of those found in the embodiments described above.

For the key sheet 31 of the third embodiment, the reinforcing layer 33 constructed of a thermoplastic elastomer that covers both sides of the bridge 13*a* of the hard resin plate 13 was exemplified. Alternatively, however, the reinforcing layer 33 may cover only one side of the bridge 13*a*. The reinforcing layer 33 may cover not all but part of the bridges 13*a*.

For the key sheet 41 of the fourth embodiment, the reinforcing inner frame 46 integrally formed with the hard resin plate 13 by die-molding was exemplified. Alternatively, however, an adhesive may be used for fixing them together. Alternatively, furthermore, a reinforcing layer corresponding to the reinforcing inner frame 46 may be formed by curing with the application of a liquefied UV-curing resin so as to correspond to the reinforcing frame 46.

For the key sheet 41 of the fourth embodiment, exemplified was the reinforcing inner frame 46 to serve as a single molded product corresponding to the shape of the bridge 13*a* of the hard resin plate 13. Alternatively, however, the reinforcing inner frame 46 may be constructed of a plurality of divided molded products. Furthermore, the reinforcing inner frame 46 may be constructed of a single molded product including the reinforcing outer frame 23 of the second embodiment. In contrast, the reinforcing inner frame 46 may include bridges 13*a* having portions which are not reinforced.

For the key sheet 41 of the fourth embodiment, a thermoplastic elastomer was exemplified as the elastic sheet 43. Alternatively, however, the elastic sheet 43 may be made of silicone rubber. In this case, the elastic sheet 43 can be fixed by adhesion of the reinforcing inner frame 46 and the reinforcing outer frame 23 with an adhesive.

Figure 25:
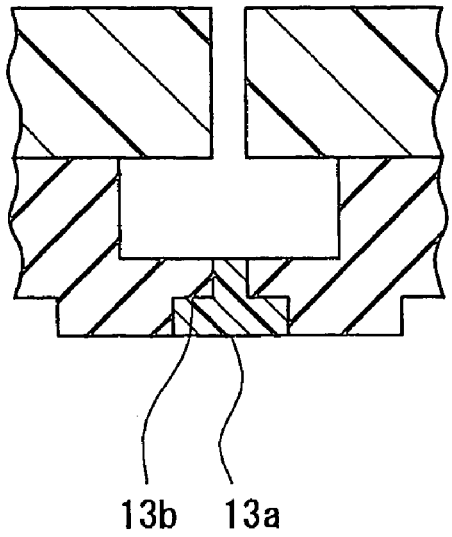
FIG. 25 is an enlarged sectional view showing a modified example of the first, second, or third embodiment of the present invention.
Figure 26:
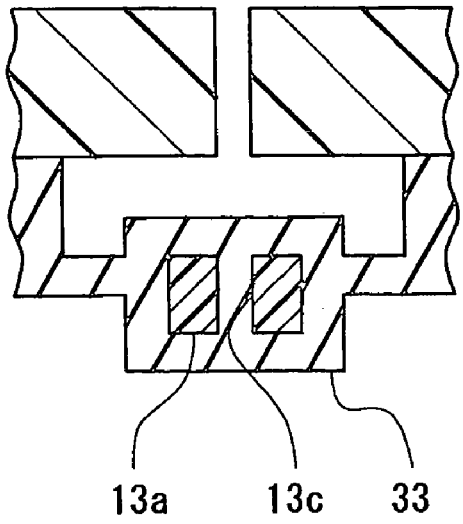
FIG. 26 is an enlarged sectional view showing a modified example of the first, second, or third embodiment of the present invention.

Furthermore, in the first and second embodiments, for example as shown in FIG. 25, a stepped portion 13*b* may be formed on the bridge 13*a* to allow the thermoplastic elastomer to be fixed on the stepped portion 13*b*. As a result, the fixing area can be increased to enhance the adhesive strength to the hard resin plate 13. Moreover, in the third embodiment, for example as shown in FIG. 26, a through hole 13*c* may be formed through the bridge 13*a*. Then, the thermoplastic elastomer is charged in the through hole 13*c* and fixed therein to increase the fixing area while forming a structure that makes connection between both sides of the bridge 13. Thus, the adhesive strength to the hard resin plate 13 can be enhanced.

Figure 27:
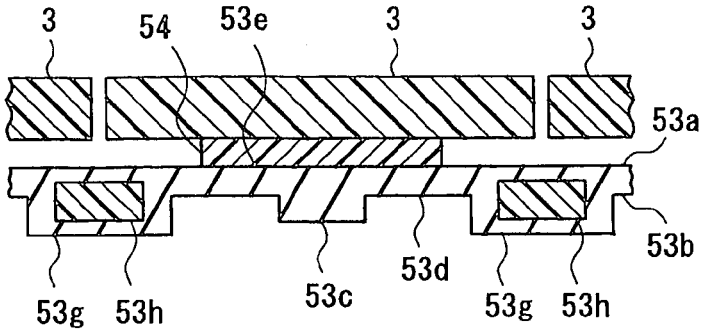
FIG. 27 is an enlarged sectional view showing a modified example of the fifth embodiment of the present invention.
Figure 28:
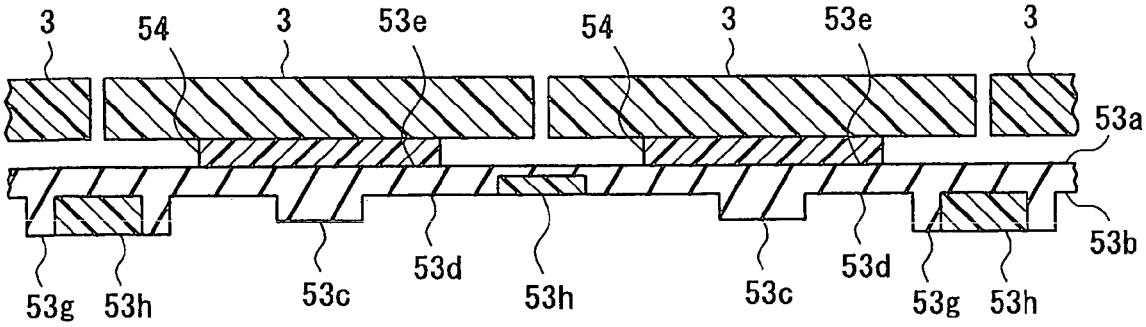
FIG. 28 is an enlarged sectional view showing a modified example of the fifth embodiment of the present invention.
Figure 29:
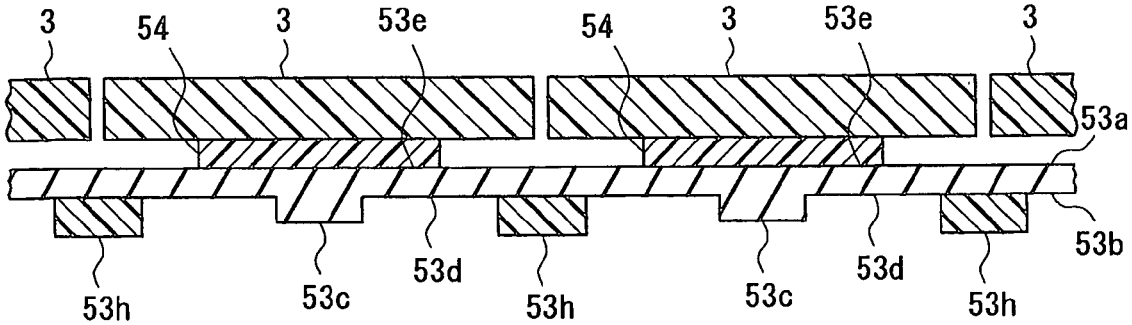
FIG. 29 is an enlarged sectional view showing a modified example of the fifth embodiment of the present invention.

In the fifth embodiment, the reinforcing inner frame 53*h* is exposed to the bottom surface 53*b* of the elastic sheet 53. In the sixth embodiment, the reinforcing inner frame 53*h* is exposed to the opposite side (i.e., the upper surface) 63*a* of the elastic sheet 53. Alternatively, as shown in FIG. 27, the reinforcing inner frame 53*h* may be completely embedded in the thick part 53*g*. Alternatively, as shown in FIG. 28, the reinforcing inner frame 53*h* may be formed on the boundary portion between the bases 53*e* instead of forming the thick part 53*g* between the adjacent bases 53*e*. Furthermore, as shown in FIG. 29, the reinforcing inner frame 53*h* may be attached on the bottom surface 53*b* as a sheet surface of the base sheet 53 using an adhesive, a double-faced tape (not shown), or the like to support the base 53*e* instead of the thick part 53. Furthermore, the reinforcing inner frame 53*h* may be fixed on the upper surface 53*a*.

It is possible to change the places in the base sheets 52, 62 where the respective reinforcing inner frames 53*h*, 63*h* are formed in response to the conformation of the key top 3. Briefly, if at least two key tops are adjacent to each other in a narrow space, there is the necessity of reinforcing with the "reinforcing member", such as the reinforcing inner frame 53. Therefore, the "reinforcing member" may be formed between at lest two bases on which the key tops are fixed.

For each of the key sheets 71, 81 of the seventh and eighth embodiments, the base 15 may be formed of a hard resin just as in the case of the base 105 of the tenth embodiment.

For the key sheet 91 of the ninth embodiment, the reinforcing layer 95 made of a thermoplastic elastomer that covered both the bridges 93*a* of the resin film 93 and the reinforcing layer 94 was exemplified. Alternatively, however, the reinforcing layer 94 may cover only one of them. In addition, the reinforcing layer 94 was entirely formed on the back surface of the resin film 93. Alternatively, the reinforcing layer 94 may be formed only on a portion that corresponds to the reinforcing outer frame 84 of the eighth embodiment and a portion that corresponds to the reinforcing outer frame 104 of the tenth embodiment. In other words, the reinforcing layer 94 may be partially formed.

In the key sheet 101 of the tenth embodiment, the reinforcing inner frame 104 was fixed on the resin film 103 with an adhesive. Alternatively, they may be integrally formed by die-molding just as in the case of the base 105. In addition, a reinforcing layer corresponding to the reinforcing inner frame 104 may be formed by applying a reactive-curing resin such as a thermosetting resin, photo-curing resin, humidity-curing resin, or pressurization and humidification curing resin, or a nonreactive-curing resin such as a thermoplastic resin and curing the applied resin.

For the key sheet 101 of the tenth embodiment, exemplified was the reinforcing inner frame 104 to serve as a single molded product corresponding to the shape of the bridge 103*a* of the resin film 103. Alternatively, however, the reinforcing inner frame 104 may be constructed of a plurality of divided molded products. Furthermore, the reinforcing inner frame 104 may be constructed of a single molded product including the reinforcing outer frame 84 of the eighth embodiment. In contrast, the reinforcing inner frame 104 may include bridges 103*a* having portions which are not reinforced.

Figure 30:
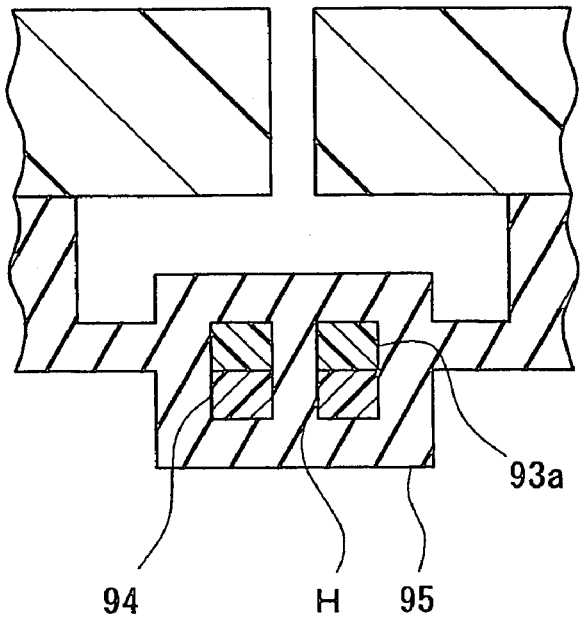
FIG. 30 is an enlarged sectional view showing a modified example of the ninth embodiment of the present invention.
Figure 31:
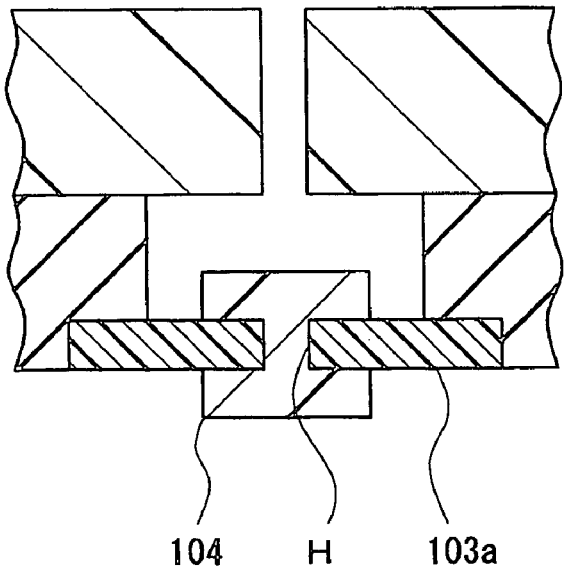
FIG. 31 is an enlarged sectional view showing a modified example of the tenth embodiment of the present invention.
Figure 32:
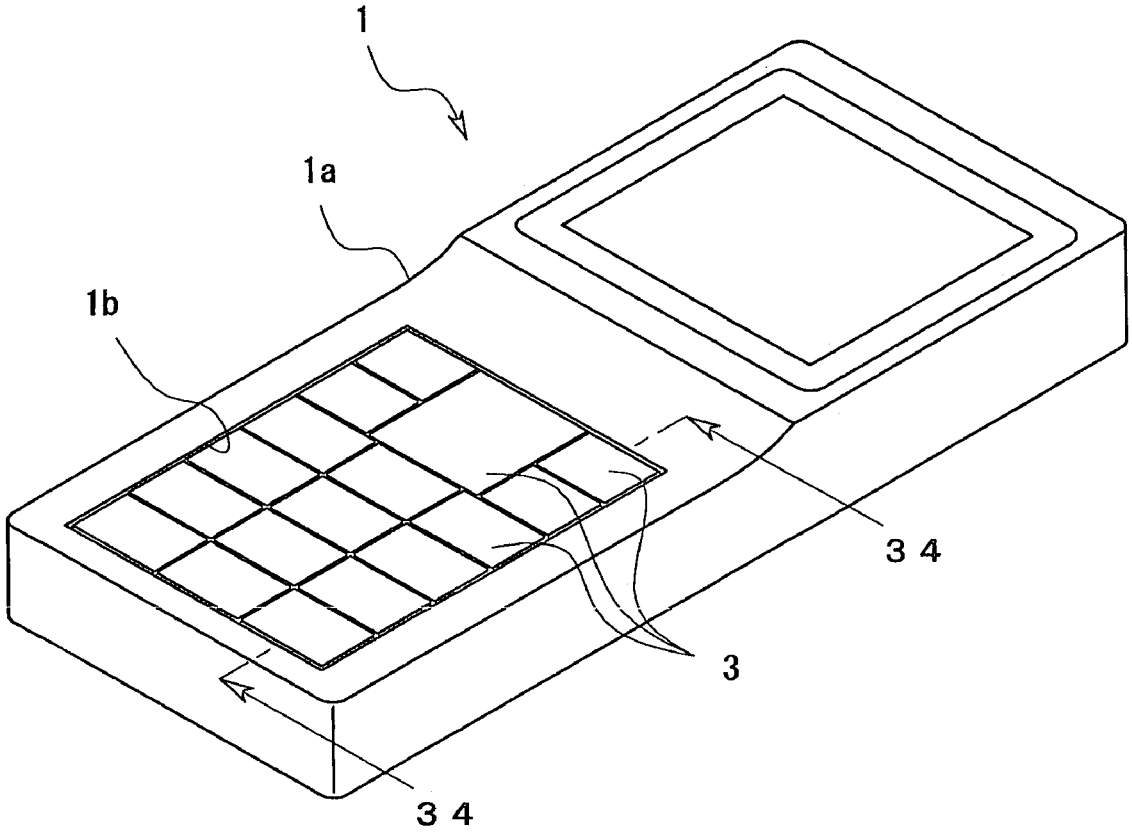
FIG. 32 is an external perspective view of a mobile phone according to a conventional example.
Figure 33:
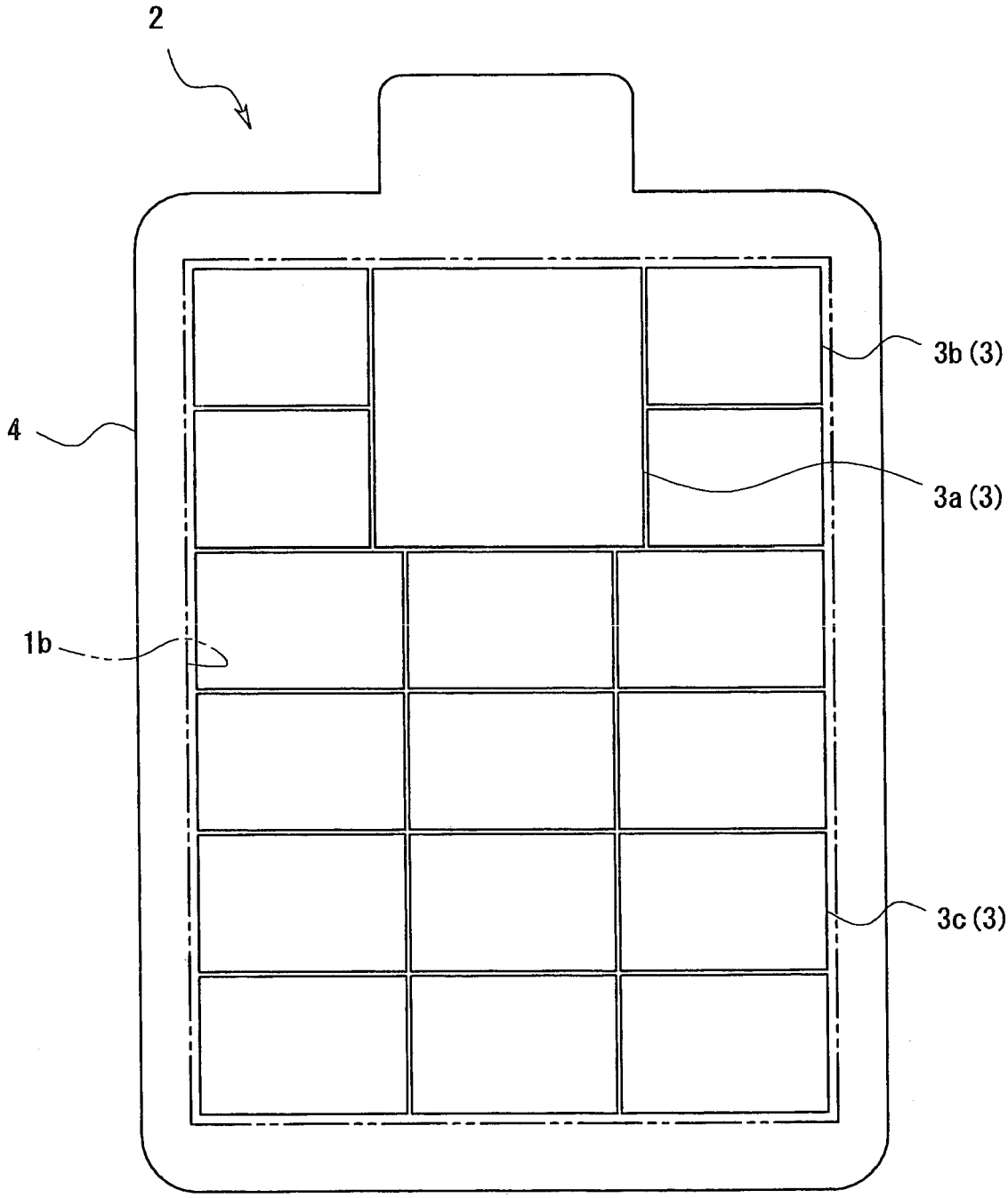
Fig.33 (Prior Art)
FIG. 33 is an external view of a key sheet to be installed in the mobile phone shown in FIG. 32.
Figure 34:
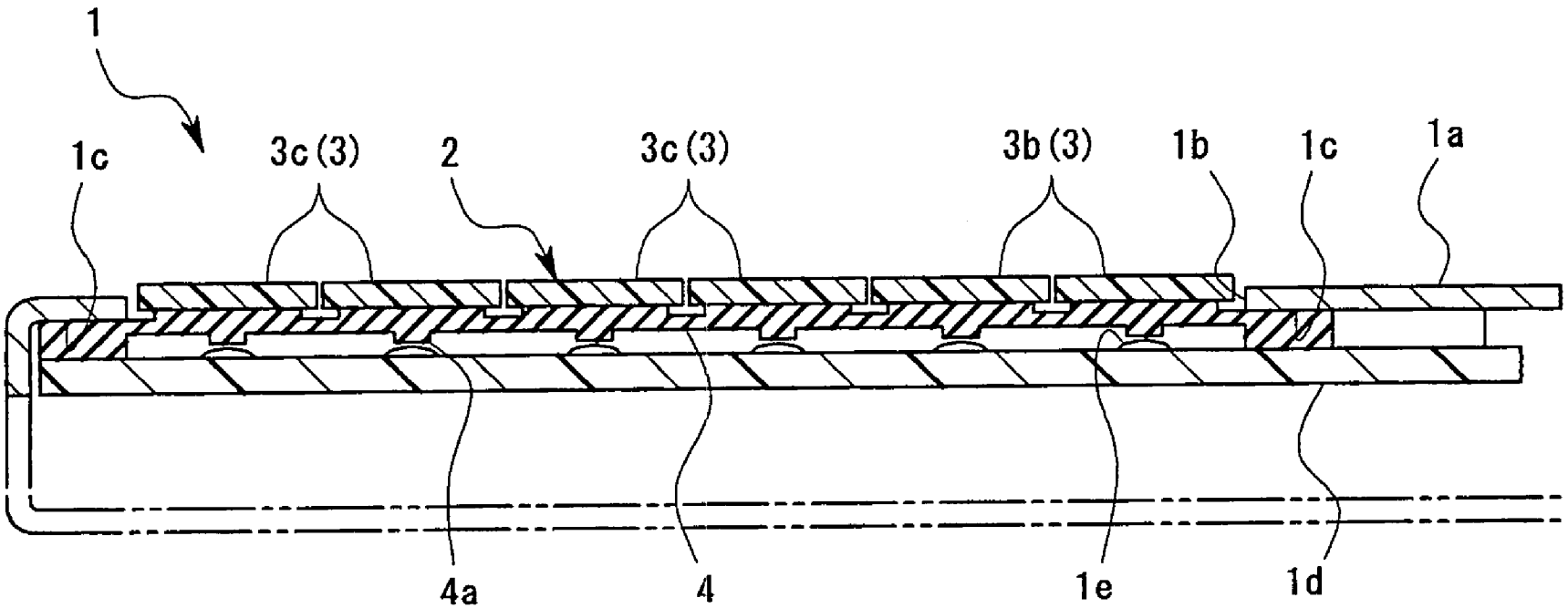
Fig.34 (Prior Art)
FIG. 34 is a schematic sectional view of the mobile phone taken along the line 34—34 of FIG. 32.
Figure 35:
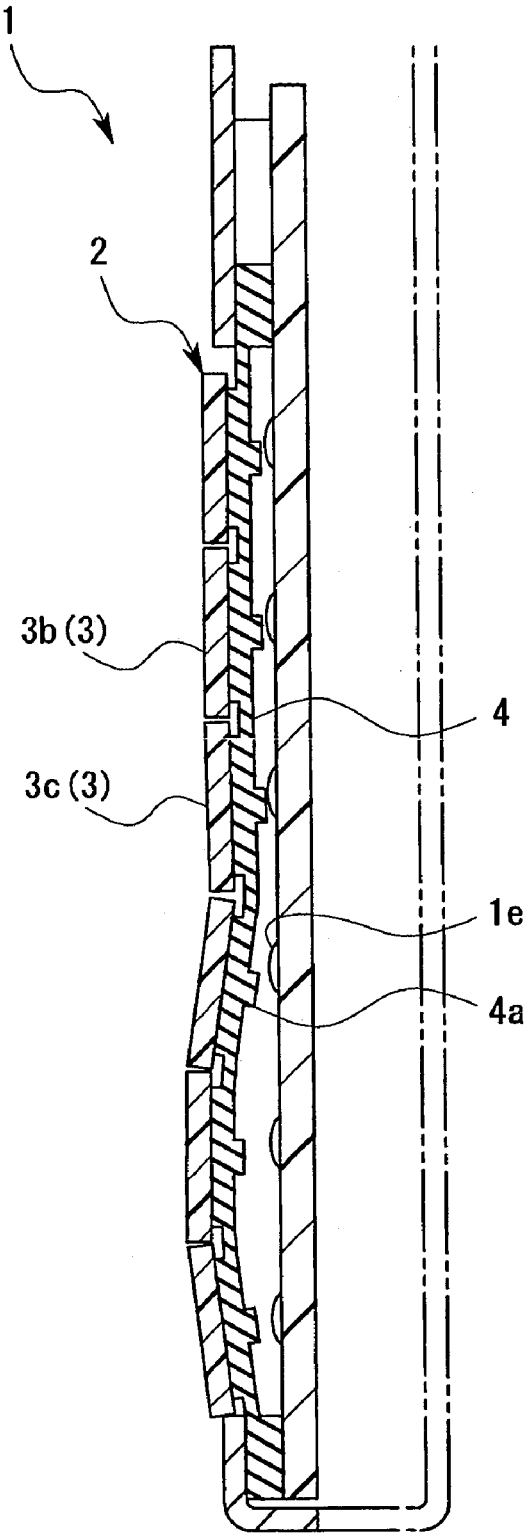
Fig.35 (Prior Art)
FIG. 35 is a schematic sectional view that corresponds to FIG. 34, where the mobile phone is turned upright.
Figure 36:
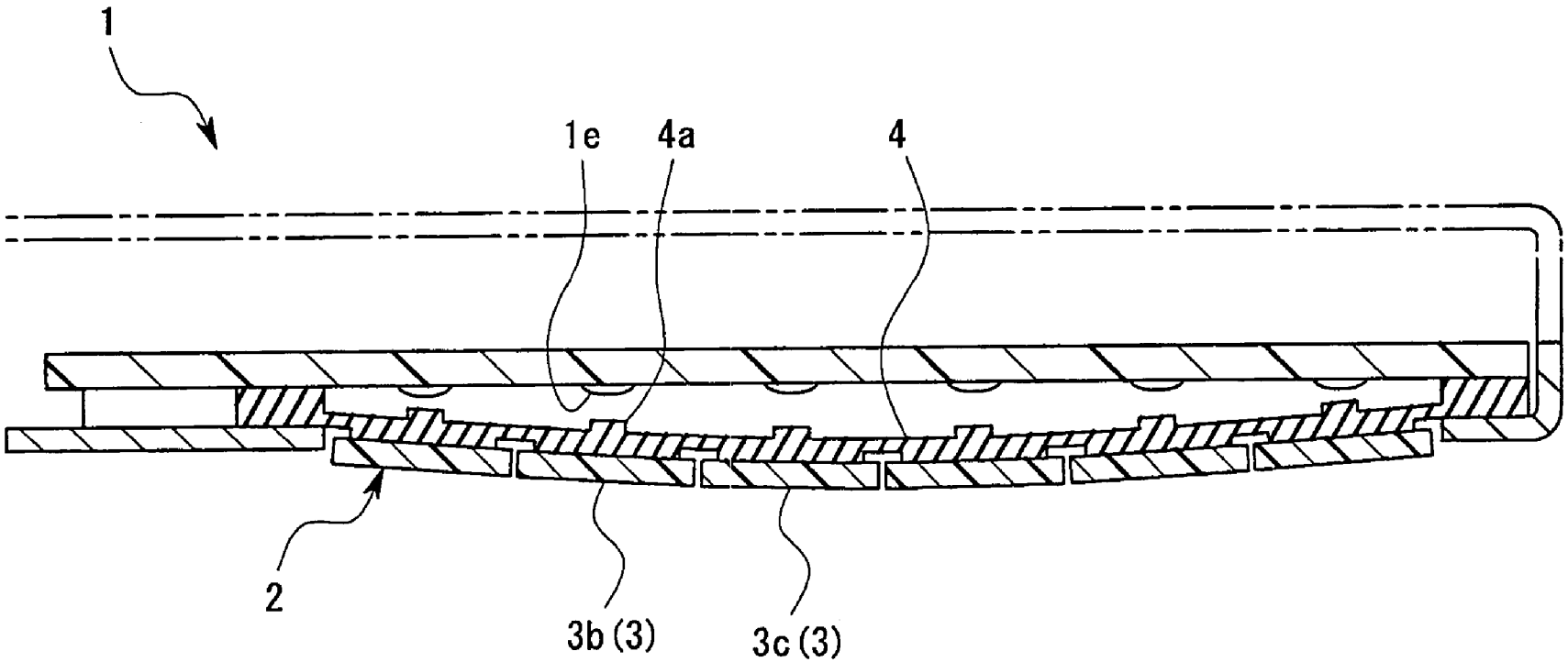
Fig.36 (Prior Art)
FIG. 36 is a schematic sectional view that corresponds to FIG. 34, where the mobile phone is turned upside down.

Furthermore, in the ninth embodiment, for example as shown in FIG. 30, a through hole H may be formed through the bridge 93*a* and the reinforcing layer 94. Then, a thermoplastic elastomer is charged in the through hole H and fixed therein to increase the fixing area while forming a structure that makes connection between both sides of the bridge 93*a*. As a result, the adhesive strength to the resin film 93 can be enhanced. Furthermore, in the case of the embodiment in which the reinforcing inner frame 104 of the tenth embodiment is formed by injection molding, for example as shown in FIG. 31, a through hole H is formed through the bridge 103*a*. Then, a molten resin is charged and fixed in the through hole H to increase the fixing area while forming a structure that makes connection between both sides of the bridge 103*a*. As a result, the adhesive strength to the resin film 103 can be enhanced.

Furthermore, in the above embodiments, the key sheets 11, 21, 31, 41, 51, 61, 71, 81, 91, and 101 to be used in the mobile phone 1 were exemplified. Alternatively, those key sheets may be used in other devices. In addition, each of those key sheets is characterized in that the distortion of the key sheet can be prevented even though the key sheet is turned upright or turned upside down in use. Thus, each of those key sheets is particularly suitable for portable devices including mobile phones, PDAs, and remote controllers in which a key sheet is turned upright or turned upside down in use.

EXAMPLES

Hereinafter, one of the concrete examples of the process for manufacturing a key sheet will be described below.

Here, a key sheet (51) configured as shown in FIG. 12 was manufactured. A reinforcing inner frame (53*h*) to serve as a reinforcing member was molded using a polycarbonate resin containing a constitutional unit represented by the formula (2) described above and having a deflection temperature under load of 180° C. Then, the reinforcing inner frame (53*h*) was transferred into the cavity of a die for forming an elastic sheet (53) made of a rubber-like elastic body. Subsequently, silicone rubber as a rubber-like elastic body was injected into the cavity and then the silicone rubber was subjected to crosslinking (vulcanization) for 5 minutes at 160° C., while a base sheet (52) was obtained such that the silicone rubber was combined with the reinforcing inner frame (53*h*) made of the polycarbonate resin. The base sheet was fixed to a separately molded key top (3) made of a polycarbonate resin with a urethane acrylate adhesive (54) through UV irradiation to obtain a key sheet (51) of the present invention. The resulting key sheet (51) did not show any deformation such as "warping" of the base sheet (52). Thus, the key sheet (51) had good accuracy of dimension.

Furthermore, a base plate (52) integrally formed with silicone rubber was prepared under the same conditions as those described above using, as a material for the reinforcing inner frame (53*h*), a polycarbonate resin containing a constitutional unit represented by the formula (5) described below and having a deflection temperature under load of 135° C. instead of the polycarbonate resin containing the constitutional unit represented by the formula (2). The resulting base sheet (52) was slightly "warped". Thus, when using the resin, there was a need to use a die for the production of the reinforcing inner frame (53*h*) independently prepared exclusively for the resin to prepare a reinforcing inner frame (53*h*) previously deformed in consideration of the generation of warping.

Formula (5)

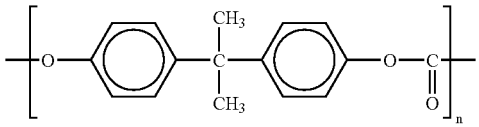

(wherein n represents an integer in the range of 40 to 150)

What is claimed is:

1. A key sheet comprising:

a base sheet; and a plurality of key tops arranged on the base sheet and exposed from an operation opening formed in a case of a device, the operation opening having no partition bridge, wherein the base sheet includes:

a plurality of bases for fixing the key tops on the base sheet; and a resin film having through holes to fix the bases thereon by bridging over the bases.

2. A key sheet according to claim 1, further comprising:

a reinforcing member mounted on the resin film to suppress distortion of the base sheet.

3. A key sheet according to claim 2, wherein the reinforcing member comprises a resin molded product adhered on the resin film.

4. A key sheet according to claim 2, wherein the reinforcing member comprises a resin molded product integrally molded with the resin film by die-molding.

5. A key sheet according to claim 2, wherein the reinforcing member comprises a cured product of a liquefied resin applied on the resin film.

6. A key sheet according to claim 1, wherein the base is made of a rubber-like elastic body, and the base has a flexible portion to be displaced by pushing the key top.

7. A key sheet according to claim 1, wherein the base is made of a hard resin, and the resin film has a flexible portion to be displaced by pushing the key top.

8. A key sheet comprising:

a base sheet; and a plurality of key tops arranged on the base sheet and exposed from an operation opening formed in a case of a device, the operation opening having no partition bridge, wherein the base sheet includes:

a plurality of bases made of a rubber-like elastic body for fixing the key tops; and a thin-plate like reinforcing member made of a hard resin for supporting the bases while allowing displacement upon pushing.

9. A key sheet according to claim 2 or 8, wherein the reinforcing member is made of a heat-resistant hard resin having a deflection temperature under load of 170° C. or more.

10. A key sheet according to claim 9, wherein the hard resin that constitutes the reinforcing member comprises a heat-resistant hard resin selected from the group consisting of a polyacrylate resin, a polyallylsulfonate resin, a polyethersulfonate resin, and a polysulfonate resin.

11. A key sheet according to claim 9, wherein the hard resin that constitutes the reinforcing member comprises a heat-resistant polycarbonate resin including a constitutional unit represented by the following general formula (1):

General Formula (1)

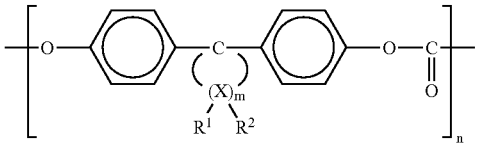

(wherein X represents a carbon atom and m represents an integer of 4 to 7, R1 and R2 may be individually selected for each X, and each independently represents a hydrogen atom or an alkyl group having 1 to 6 carbon atoms, and n represents an integer of 40 to 100).

12. A key sheet according to claim 2 or 8, wherein the hard resin that constitutes the reinforcing member contains a resin reinforcement.

13. A key sheet according to claim 12, wherein the resin reinforcement contains at least one selected from the group consisting of a glass fiber, a metal fiber, a carbon fiber, an aramid fiber, and a ceramic fiber.

14. A key sheet according to claim 8, wherein the reinforcing member is constructed of a single plate having through holes to fix the bases thereon by bridging over the bases.

15. A key sheet according to claim 8, wherein:

the base sheet is formed of an elastic sheet made of a rubber-like elastic body having bases; and the reinforcing member is partially mounted between the adjacent bases.

16. A key sheet according to claim 8, wherein:

the base sheet is formed of an elastic sheet made of a rubber-like elastic body having bases; and the reinforcing member is mounted on an outer edge portion of the elastic sheet.

17. A key sheet according to claim 2 or 8, wherein a pressure-contact portion made of a rubber-like elastic body is formed on the base sheet.

* * * * *